US010001038B2

(12) United States Patent
Will

(10) Patent No.: US 10,001,038 B2
(45) Date of Patent: Jun. 19, 2018

(54) HEAT-INSULATED SYSTEM FOR LUBRICATING ROTATING AND OSCILLATING COMPONENTS OF A MOTOR VEHICLE

(71) Applicants: INO8 PTY LTD., Jan Juc, Victoria (AU); Frank Will, Jan Juc, Victoria (AU)

(72) Inventor: Frank Will, Jan Juc (AU)

(73) Assignee: INO8 PTY LTD, Victoria (AU)

( * ) Notice: Subject to any disclaimer, the term of this patent is extended or adjusted under 35 U.S.C. 154(b) by 160 days.

(21) Appl. No.: 14/769,657

(22) PCT Filed: Feb. 25, 2014

(86) PCT No.: PCT/EP2014/053639
§ 371 (c)(1),
(2) Date: Aug. 21, 2015

(87) PCT Pub. No.: WO2014/128308
PCT Pub. Date: Aug. 28, 2014

(65) Prior Publication Data

US 2016/0010520 A1 Jan. 14, 2016

(30) Foreign Application Priority Data

Feb. 25, 2013 (DE) ..... 10 2013 101 844

(51) Int. Cl.
*F01M 5/00* (2006.01)
*F01M 5/02* (2006.01)

(52) U.S. Cl.
CPC ..... *F01M 5/021* (2013.01); *F01M 5/001* (2013.01)

(58) Field of Classification Search
CPC ..... F01M 5/021; F01M 5/005; F01M 5/001
See application file for complete search history.

(56) References Cited

U.S. PATENT DOCUMENTS

2012/0006622 A1* 1/2012 Will ..... F01M 5/001 184/6.22
2012/0234286 A1* 9/2012 Quix ..... F01M 5/00 123/196 AB

FOREIGN PATENT DOCUMENTS

DE 3032090 4/1982
DE 3300946 1/1983
(Continued)

OTHER PUBLICATIONS

Office Action issued in related Japanese Application No. 2015-558492 dated Jun. 7, 2016.
(Continued)

*Primary Examiner* — Kevin A Lathers
(74) *Attorney, Agent, or Firm* — George H. Spencer; Roberts Mlotkowski Safran Cole & Calderon P.C.

(57) ABSTRACT

The invention relates to a thermally insulated Lubrication system (100) for the lubrication of rotating or oscillating components with at least one oil suction pipe (3) arranged in an oil reservoir (1), an oil pump (4) connected to the oil suction pipe (3), and a heat source (7) connected to the oil pump (4) and downstream from this, further connecting lines (10) for feeding oil to lubrication points (11) that are structurally integrated into a metal structural environment (63) of a metal housing, after which oil is returned to the oil reservoir (1).

Figure 1:
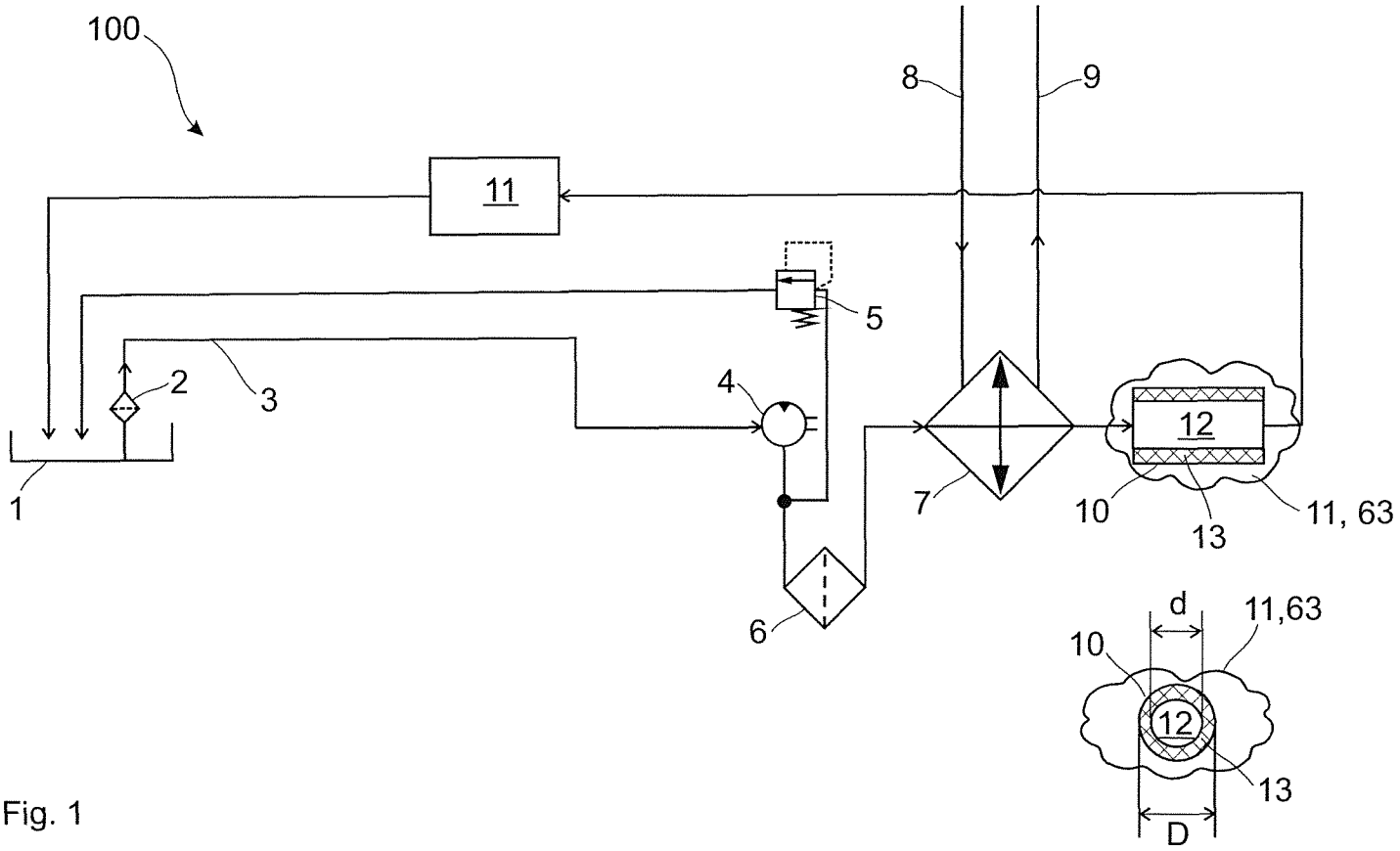

It is proposed that at least one connecting line (10) between the heat source (7) and the lubrication point (11) downstream from the heat source has internal insulation (13) on its inside walls, wherein the thermal conductivity of the internal insulation (13) is 5% or less than the thermal conductivity of the connecting lines or of the rest of the structural environment (63), and that the heat source (7) is switched off, or at least its heat output is reduced, when a first upper oil limit temperature is reached.

(Continued)

By improved insulation, fast heating and hence a lowering of fuel consumption in the cold starting phase is achieved.

23 Claims, 9 Drawing Sheets

(56) References Cited

FOREIGN PATENT DOCUMENTS

| | | | |
|---|---|---|---|
| DE | 4427256 | | 2/1995 |
| DE | 102005052632 | | 5/2007 |
| DE | 102009013943 | | 3/2009 |
| DE | 1020099051820 | | 9/2010 |
| DE | 102011005496 | | 3/2011 |
| EP | 2103789 | | 9/2009 |
| GB | 2451749 | | 6/2008 |
| JP | 1983135312 | A | 8/1983 |
| JP | 61-53544 | U1 | 4/1986 |
| JP | 1997209734 | A | 12/1997 |
| JP | 2001323808 | | 11/2001 |
| JP | 2001323808 | A | 11/2001 |
| JP | 2004205198 | A | 7/2004 |
| JP | 2004232546 | A | 8/2004 |
| JP | 2006258089 | A | 9/2006 |
| JP | 2010084721 | | 4/2010 |
| JP | 2010203263 | A | 9/2010 |
| JP | 20117126 | A | 8/2012 |
| WO | 2010106179 | | 9/2010 |

OTHER PUBLICATIONS

Japanese Office Action for corresponding Japanese Patent Application No. 2015-558492 dated Oct. 4, 2016 and English translation thereof.

International Preliminary Examination Report PCT/EP2014/053639 dated Dec. 18, 2014.

* cited by examiner

Stand der Technik

HEAT-INSULATED SYSTEM FOR LUBRICATING ROTATING AND OSCILLATING COMPONENTS OF A MOTOR VEHICLE

The invention relates to a thermally insulated lubrication system for the lubrication of rotating or oscillating components, in particular a lubrication system for a motor vehicle that can be employed for the lubrication of moving parts of a combustion engine such as a petrol or diesel engine and/or for the lubrication of a transmission. The lubrication system can for example be used in a conventionally driven vehicle or in a hybrid or electric vehicle, and also in stationary plant such as electricity generators, processing machines etc.

PRIOR ART

Lubrication systems for moving parts of a drive, in particular of an engine or mechanical transmission, are sufficiently well known. Their purpose is to reduce the friction between moving parts and to improve the smoothness with which the moving parts run against one another. This lowers abrasion, reduces the thermal heating of the parts and thus extends their service life. Stiffness of moving parts moreover leads to an increased drive energy that must be used in an unproductive manner to overcome the stiffness, and entails an increased consumption of fuel or electricity so that firstly exhaust emissions and operating costs are increased, and for example a range of a motor vehicle is reduced. In particular, a reduction in exhaust pollution and a low energy consumption are not only technically desirable properties of an engine, but are internationally indispensable conditions for compliance with various state standards and limit values. Not least, inefficient lubrication management of a drive can lead to increased taxes and dues levied on the operator.

In a cold-starting phase, in particular at low temperatures such as 0° C., or extreme temperatures such as −15° C. or lower, the problem arises that a lubricating medium that is used, in particular lubricating oil, exhibits a high viscosity and thus a reduced lubricating property. Thus in a combustion engine, the fuel consumption during an NEDC test starting from cold (starting temperature approx. 24° C.) was about 10 to 15% higher than when the same test is carried out with an engine oil temperature in a hot condition at about 90° C., known as the NEDC hot test. This is in part due to the fact that the lubricating oil exhibits a greater viscosity at low temperatures. At the same time, a high proportion of the energy supplied is dissipated, unused, as exhaust gas enthalpy. This represents in total about 30 to 40% of the energy of the supplied fuel.

One way of reducing the friction losses is to use high-quality lubricating oils with reduced viscosity at low temperatures, while another possibility aims at a deliberate and fast heating of the lubricating medium in the cold-starting phase.

Proposals for the use of heat exchangers that deliver an increased heat input into the lubrication system, in particular during a cold-starting phase, are aimed at accelerated heating during a cold-starting phase. From a variety of publications, it is known in this respect that heating the engine oil with the aid of an exhaust gas/oil heat exchanger can significantly reduce the fuel consumption and the exhaust emissions. This means the warming-up phase of the engine is accelerated in that exhaust gas heat exchangers are used which, in a complicated manner, heat the engine oil and reduce the oil pressure. This however gives rise to the problem that the engine, and in particular the engine oil, must be protected from being overheated during this heating phase. For this reason, additional high-performance oil coolers are used. The known solutions are, however, technically complex in design as well as fault-prone, and only lead to a relatively small reduction in the fuel consumption, so that for economic reasons they are not practically implemented in most cases.

Reference is made here by way of example to DE 10 2009 013 943 A and to PCT/EP2010/053643, each of which proposes an oil bypass line with which a reduced quantity of lubricating oil for oil lubrication is, while at least partially decoupled from a large quantity of lubricating oil, selectively passed during a starting phase through parts of a combustion engine or of a transmission that heat up quickly.

An oil lubrication system can be found in JP 2001 323808 A in which oil can be introduced by means of an oil pump into a lubrication system from an oil suction pipe arranged in an oil sump, wherein this oil can be heated up by an exhaust gas system by means of an oil bypass line and a heat exchanger. The heated oil can be stored in a thermally insulated intermediate tank and passed by means of a feed line directly underneath the suction bell of the oil sump back into the lubrication system.

Further proposed solutions are discussed in the conference papers: Will, F.: "A novel exhaust heat recovery system to reduce fuel consumption", F2010A073, FISITA Conference Budapest (International Federation of Automotive Engineers Society), Hungary 2010, and in Will, F., Boretti, A.: "A new Method to warm up Lubricating Oil to improve Fuel Economy", SAE 2011-01-0318, 2011 (Society of Automotive Engineers).

DE 10 2011 005 496 A1 describes a lubrication system for a combustion engine comprising an oil circuit, a cooler and a thermal reservoir arranged upstream from the engine for heating the oil. The thermal reservoir is connected in parallel with the cooler, and a valve can switch the oil circuit between the cooler and the thermal reservoir. External insulation of the oil lines to the thermal reservoir is indicated in cases where the thermal reservoir is arranged further away from the engine. External insulation is easy to apply at a later stage, and changes the mechanical dimensions and the appearance of the insulated regions to a high degree, as well as their durability and mechanical toughness. Moreover, an external insulation as a rule exhibits poor resistance to fire and thus presents a fire safety hazard; it can for example be damaged due to being gnawed by martens. A further disadvantage of external insulation is the resultant increase in surface area, which leads to increased heat loss. The total weight is also increased by external insulation. When a metal housing is, on the other hand, insulated on the inside, the weight is reduced, since part of the heavy metal housing is replaced by a lighter insulation layer, in particular of plastic. At no point in this publication is reference made to internal insulation of the oil line, in particular not in the case of a metal housing. If the housing is made of an insulating material such as plastic, a structural strength, stiffness or toughness that are comparable to a metal housing cannot be achieved, or other disadvantages result such as high costs, for example if ceramic is used.

A thermal reservoir of an oil lubrication system for storing heated transmission oil is known from DE 10 2009 051 820 A1. Transmission oil can be conveyed out of the transmission into the storage reservoir and vice versa by means of a spring-type cylinder, wherein the transmission oil can be conveyed into and out of the reservoir by spring force. The proposed thermal reservoir with spring-type cylinder comprises a complex geometry and mechanical design and is correspondingly expensive. Due to the spring-type cylinder, only a volume-increasing external insulation can be considered for a possible insulation of the reservoir housing, entailing the aforementioned disadvantages. The use of the spring-type cylinder is restricted to passive transmission lubrication.

DE 30 32 090 A1 also relates to a method for accelerated heating of lubricating oil in a warming-up phase of a combustion engine, wherein lubricating oil is to be heated more quickly by a heating pipe or heat exchanger. It is proposed that the oil sump has regulated thermal insulation in which the ventilation flaps or louvers can be opened or closed as required in order to cool the oil sump or to insulate it from the ambient air.

The disadvantages of the above proposals for reducing the friction power are the high design cost design and the increased susceptibility to faults as well as the reduction in the friction loss, which is only small in particular in relation to the expense, since the heated oil cools down again quickly when it comes into contact with cooler components such as the oil galleries in the cylinder block and cylinder head, as well as in the housing (e.g. oil sump and crank case).

The object of the following invention is to propose a lubrication system that overcomes the aforementioned disadvantages of the prior art, permits simple technical implementation and offers significantly reduced friction, in particular in the cold-starting phase.

DISCLOSURE OF THE INVENTION

The above object is achieved by a lubrication system as claimed in the independent claim 1. Advantageous embodiments of the invention are the subjectmatter of the dependent claims.

In accordance with the invention, the system for the lubrication of rotating or oscillating components comprises at least one oil suction pipe arranged in an oil reservoir, an oil pump, a heat source and further connecting lines that are integrated into a metal housing, in particular an oil gallery for distributing lubricating oil to the components, such as the crankshaft, camshaft, transmission components etc., that require lubrication. The oil reservoir can be an open reservoir that is not as a rule insulated, and its construction and design can correspond to an oil sump. It is proposed that at least one connecting line has inside the oil gallery and upstream from the heat source internal insulation on its inside walls, where the thermal conductivity of the internal insulation is 5% or less than the thermal conductivity of the connecting lines or of the rest of the oil gallery, and is preferably at least less than 1 W/(m·K), and that the heat source is switched off or is at least reduced in its heat output when a first upper oil limit temperature is reached. The outer circumference of the connecting line can be, at least at one location, at least twice as large as the inner circumference of the connecting lines.

By virtue of the above, there is provided a means for reducing the heat output of the heat source to a value that is between a lowered value and zero when a predetermined upper oil temperature is reached.

In other words, it is proposed in accordance with the invention that at least part of a connecting line behind an oil pump, i.e. in a part of the connecting line of a lubrication system that is under pressure, and preferably behind a heat source such as a heat exchanger, has insulation, in particular internal insulation, that hinders thermal heat transfer from the lubricating oil to the metal surroundings. As a result, after a volume of oil under pressure has been heated, it only loses a little of the heat it has absorbed to the metal surroundings, which have a high thermal conductivity, while it is passed to the locations requiring lubrication, in particular to the oil gallery. Thus a fast heating of the oil that is to be sent via lubrication points directly to the locations to be lubricated is achieved, with the effect of a reduced friction, in particular when cold-starting.

Although DE 10 2009 013 943 describes the use of an exhaust gas/oil heat exchanger for the heating of lubricating oil, including in combination with a cylinder head oil return line, permitting an improved lubricating effect in the cold-starting phase and thereby a saving in fuel consumption, this nevertheless requires the engine to have a complex design, and cannot be implemented in existing engine structures. It has been found that the use of an exhaust gas oil heat exchanger is advantageous, in particular in the case of powerful engines with relatively large oil galleries where the ratio of surface area to volume is particularly low. In small combustion engines, in which a significant proportion of the exhaust gas heat can be conveyed into the lubrication system, a relatively large amount of heat is dissipated to the metal surroundings as a result of the high ratio of surface area to volume, so that a particularly advantageous fast heating of the lubricating oil cannot be achieved. This can be illustrated by the following exemplary comparison: if we compare an oil feed line with a diameter of 2 mm with one of 1 mm, the volume is given by the formula $V=l\pi D^2/4$, where l is the length of the oil gallery and D is its diameter. The surface area of the oil gallery is given by $A=l\pi D$, and the ratio of surface area to volume thus corresponds to $A/V=4/D$. For a diameter D=2 mm we find a ratio of 2/mm while for D=1 mm the figure is 4/mm, which is twice as big as the figure for D=2 mm. This shows that if the diameter D is reduced by 50%, the ratio of surface area to volume is doubled. As a result of this, there is a higher volume-specific heat transfer, so that with larger diameters the temperature loss of the oil through the oil gallery is smaller, and oil at the lubrication points can be made more fluid. This effect is known from the design of engines with large combustion chambers, which have a higher specific efficiency than engines with smaller combustion chambers, since the different thermal losses through the walls are significantly lower in the case of larger combustion chambers due to the lower ratios of surface area to volume.

By the introduction of thermal insulation inside the oil gallery, in particular at lubrication points of the functional structural environment for lubricating the components, but also of the structural structural environment formed by the metal environment, crankshaft, connecting rod, camshaft, bearings, toothed wheels, parts of the housing, engine block at the inner wall of a crank or transmission housing or the parts that move against one another, several advantages can be achieved when transferring the heat into the cold engine block:

- The thermal insulation increases the thermal resistance.
- The surface area-to-volume ratio is reduced.
- The volume of oil, and hence also the amount of oil to be heated, in the oil gallery is reduced.
- The thermal resistance is increased due to the contact resistance between the insulation and the engine block or the cylinder heads.

By a reduction in the surface area-to-volume ratio, less heat is dissipated to the metal surroundings. This can be illustrated by way of example by considering an insulation line with a thermal conductivity of 1 W/(m·K) in an oil gallery with a diameter of 20 mm and an internal diameter of 10 mm. The thermal transfer resistance is obtained by considering a thermal transfer coefficient of h=40 between the oil and the cylinder block, where it is assumed that the oil is 20° C. hotter than the engine block. This results in a thermal resistance R=1/(hA)=1/(hlπD)=0.4 K/W. The thermal resistance is described by $$R_{pipe} = \frac{\ln\left(\frac{r_o}{r_i}\right)}{2\pi kl}$$

where $r_0$=external diameter, $r_i$=internal diameter, l=length of the oil gallery and k=specific material constant. This therefore results in a thermal resistance of Ri=0.1 k/W. With a surface transfer resistance hc of 40 W/(m$^2$K), a transfer resistance of Rc=0.4 mK/W is obtained. For the reduction of the surface area-to-volume ratio of the volume of the insulation compared with the original volume, the result is Vi/V=(Di/D)$^2$=0.25, or 25%, with Di=1 mm and D=2 mm.

As a final result, it can be said that with the values used above:

The insulation increases the thermal transfer resistance by 25%,

The surface area-to-volume ratio is reduced by 50%, which increases the thermal resistance by a further 100%, The volume of oil in the oil gallery is reduced by 75%, The thermal resistance, due to the contact resistance, is again increased by a further 100%.

For this reason, the total thermal transfer resistance is 3.3 times greater than it would be without the proposed internal insulation. Better heating can be achieved for this reason, since the energy lost by the oil in the cold-starting phase is lowered and improved lubrication in the cold-starting phase is provided.

In the publication by the Japanese Society of Automotive Engineers (JSAE) 235-20125071, it is proposed that for improved heating of oil in a cold-starting phase, the oil in the oil reservoir is divided into two partial volumes, wherein in a warming-up phase only part of the oil in the oil reservoir is used for lubrication. If the same quantity of heat is introduced into the reduced volume of oil, the oil can heat up twice as quickly than if the quantity of heat were introduced into the total oil quantity. It has however been found that this is not applicable, as is illustrated in the publication JSAE 235-20125071. It has been shown in this case that by dividing the oil reservoir into two partial volumes it became clear in the course of a test that for the more outwardly positioned and colder volume of oil the maximum temperature of 85° C. was reduced to 45° C., i.e. by 40° C., whereas in the inner volume of oil the temperature could not be raised by the same 40° C. from 85° C. to 125° C. Since the volume of oil in the inner chamber was less than that in the outer chamber, it was expected that the increase in temperature would be correspondingly greater. This too has turned out to be a misapprehension, since the temperature on the inside could only be increased by a maximum of 5° C., which led to a very small saving in fuel of merely 0.8%. It was recognized that the cause was that the heat in the inner volume of oil is mainly dissipated by the heat transfer between the engine block and the crankshaft, where the oil is spun out onto the outer wall of the crankcase as soon as it reaches the crankshaft bearing. Due to their large surface areas, the temperatures of the housing and the engine block thus predominantly determine the oil temperature. For this reason, the oil temperature cannot significantly rise above the temperature of the coolant and of the engine, at least not during average cold-starting phases, and therefore only a small saving in fuel consumption can be achieved. An improved insulation however overcomes these disadvantages, leads to a significantly reduced friction, a significantly lower consumption, and lower exhaust emissions.

An interior insulation of a metal housing and of a metal pipeline furthermore allows oil lines and housings to be manufactured from metal or from robust yet thermally conductive materials, and to retain given external mechanical dimensions, since only an internal insulation is to be employed, and external dimensions and design details can be retained, thereby allowing redesigning an existing unit to be avoided. By internal insulation of oil lines and housing components, existing engines and units can become more efficient without having to undergo design changes.

According to an advantageous development of the invention, the housing of the lubrication system, in particular a crankshaft or transmission housing, can be insulated by an internal insulation, wherein the thermal conductivity of the internal insulation is 5% or less than the thermal conductivity of the structural environment, in particular the thermal conductivity of lubrication points, a housing, the components to be lubricated, a metal environment, and preferably is at least less than 1 W/(m·K). The structural environment describes a functional structural environment of the lubrication system, i.e. lubrication points at which surfaces move relative to one another, as well as structural structural environments, i.e. the surrounding materials such as the metal housing, components, engine block and so forth.

According to a further advantageous development, the oil reservoir can be insulated by an internal insulation, wherein the thermal conductivity of the internal insulation is 5% or less than the thermal conductivity of the oil reservoir, and is preferably less than 1 W/(mK). Alternatively or in addition; the oil reservoir can be completely or at least partly manufactured from an insulating material having a thermal conductivity of preferably at most less than 1 W/(mK).

According to an advantageous development of the invention, at least one of the rotating or oscillating components to be lubricated can be insulated by at least an internal insulation and/or external insulation, wherein the thermal conductivity of the external insulation is 5% or less than the thermal conductivity of the rotating or oscillating components to be lubricated, and is preferably less than 1 W/(mK).

By insulation of both the crankcase and of the oil sump from the inside, and also at least partial regions of the rotating or oscillating components to be lubricated, the oil can only lose a small amount of heat to the metal environment, and is not cooled down so strongly, whereas the oil in the cold-starting phase is heated by higher heat input, for example by a heat source, for example by an exhaust gas/oil heat exchanger. By the insulation of the crankshaft, the thermal mass that is available for cooling the oil is reduced, and by the insulation of the inside of the crankcase, which can be regarded as very important for retention of the oil's heat, an improved heating with low viscosity of the oil can be achieved.

According to an advantageous development, a highly insulated thermal reservoir, can in particular be surrounded by a thermal reservoir insulation at least 5 mm thick with a thermal conductivity of less than 0.01 W/(m·K), arranged in particular between an oil suction pipe and an oil pump, or between an oil pump and a heat source, or between a heat source and a lubrication point, wherein preferably a temperature loss of oil with a temperature of 100° C. to 80° C.

at an ambient temperature of 25° C. takes more than 6 hours. Preferably the thermal reservoir insulation can be designed as vacuum insulation.

To achieve an improvement in the heat storage in the aforementioned thermal reservoir, it can be advantageous for the oil connecting lines and/or an outer jacket of the thermal reservoir to consist of a thermally insulating material with a thermal conductivity of less than 20 W/(m·K). A plastic insulation can be advantageously used for this purpose. The outer jacket of the thermal reservoir can moreover be designed with double walls, and an insulating layer of aerogel having a thermal conductivity of less than 0.04 W/(m·K) can be arranged in the intermediate space between the inner wall and the outer wall of the outer jacket. The volume filled with aerogel can furthermore have a pressure lower than that of the surroundings. This significantly improves the insulation, and heat losses or an unwanted input of heat are prevented.

On the basis of the lubrication system with the thermal reservoir, the lubrication system can comprise in a further advantageous development of the invention a bypass valve, so that when a second upper oil limit temperature of at least 90° C. is reached outside the thermal reservoir, the thermal reservoir is filled with oil, and during a cold start of the components to be lubricated, when the temperature outside the thermal reservoir is below a predetermined first lower oil limit temperature of at most 50° C., it can deliver the stored oil in the thermal reservoir to the lubrication system.

The use of thermal reservoirs in a lubrication system has been known for several years. These are often employed preferably to warm the passenger compartment and to reduce exhaust gases, particularly when cold-starting below 0° C., as has been illustrated before now in publication SAE 922244. The disadvantages of such thermal reservoirs are similar to those of the aforementioned two-part oil sumps or oil reservoirs, wherein the saving in fuel turns out to be only small, as studies carried out at ambient temperatures of 24° C. have shown. The explanation as to why thermal reservoirs of this type can only make a small contribution to reducing fuel consumption are also the same as those applying to a two-part or multi-part oil sump, since the heat introduced into the cylinder head and into the engine block is quickly dispersed again. The proposed thermal reservoir can however advantageously overcome this with the upstream forms of embodiment, where excess heat can be supplied to the thermal reservoir from a cooling system or by a cooler or by an oil cooler, and the heat immediately lowers the oil viscosity due to the improved thermal insulation and contributes to a reduction in friction, thus leading to a reduction in fuel consumption.

On the basis of the lubrication system with the thermal reservoir, it is possible in an advantageous development for the thermal reservoir to comprise at least one separate chamber to be filled with a phase change material, in particular with a sugar alcohol such as erythritol, threitol or a paraffin or similar, or a salt, preferably a hydrate, nitrate, hydroxide or chloride such as magnesium chloride hexahydrate or magnesium nitrate hexahydrate. The latent heat of fusion of the phase change material should be significantly greater than the heat that the thermal reservoir can store on the basis of the temperature difference between the first lower and first upper oil limit temperatures. The melting temperature of the phase change material should in particular be lower than the first upper oil limit temperature, and preferably—provided the melting temperature of the phase change material is greater than 100° C.—the phase change material should be erythritol, with a melting temperature of about 120° C., so that the highest possible temperature can be present in the thermal reservoir during a cold start. A sugar alcohol is preferably used as the phase change material, and the melting temperature of the phase change material is above 100° C.

As was already stated above, latent heat reservoirs are already known from the prior art. In various embodiments they employ salts having a melting temperature of between 60° C. and 80° C., such as barium hydroxide or sodium silicate, where such salts are aggressive to other materials and cause corrosion damage which can lead to leaks in the cooling system or in the lubrication system. For this reason, series production of latent heat reservoirs of this type has been discontinued. A further disadvantage of already known latent heat thermal reservoirs with phase change material was that the melting temperature is typically between 60° C. and 80° C., which is significantly too low for an optimum temperature for oil lubrication, which is preferably around 120° C. The use of such latent heat reservoirs with phase change material based on salt was thus also unable to provide sustainably improved lubrication properties in cold-starting applications. A use of phase change material with phase change temperatures above 80° C., in particular erythritol, as the latent heat storage medium overcomes these problems, since it has a melting temperature that is optimum for lubrication with engine oils.

Based on the lubrication system with the thermal reservoir, the thermal reservoir is in an advantageous embodiment of the invention cylindrical in form and comprises a free piston of thermally insulating material that divides the thermal reservoir into two chambers. In this way, when the thermal reservoir is filled with oil above a first upper oil limit temperature of at least 90° C. into the first chamber, a volume of oil is pushed back from the second chamber into the lubrication system, and when the oil is emptied from the first chamber in a cold-starting phase under a first lower limit temperature of at most 50° C. into the lubrication system, the second chamber is filled with oil. The oil level in the oil reservoir is thus only affected to an insignificant extent, and the thermal reservoir can be used when required as a heat source, in particular as a heating apparatus, and as a heat sink, in particular as a cooling apparatus. The oil limit temperature can be an oil temperature of lubricating oil somewhere in the lubricating oil circuit, advantageously directly at a connecting point of the thermal reservoir or an oil outlet point at which the highest oil temperatures to be expected typically occur, such as the location of the outlet from the engine block etc. In the case of filling the thermal reservoir, hot oil from the oil circuit is received by the thermal reservoir and cooler oil is released; the thermal reservoir thus acts as a heat sink. In a cold-starting phase, and when emptying the thermal reservoir, cooler oil is received and hot oil is released; the thermal reservoir serves as a heat source.

When the parts to be lubricated are under high stress, the oil temperature increases, so that a cooling effect of the lower-temperature oil stored in the insulated thermal reservoir can be exploited. The thermal reservoir can thus be advantageously set up to cause oil to be drained from the first chamber for cooling the oil as soon as oil in the oil circuit exceeds a second upper oil limit temperature of at least 110° C. In that case, an oil temperature of oil in the first chamber is typically lower than the second upper oil limit temperature, so that the oil flowing out of the thermal reservoir is cooler than the oil that is flowing in. A cooling of the oil can effectively be achieved in this way, while an optimum lubricating effect and viscosity can be achieved and overheating in the oil circuit avoided.

It is a further problem of thermal reservoirs that during the cold-starting phase, returning cooled oil mixes with the stored heated oil, so that a mix temperature results that is lower than the previous temperature in the thermal reservoir before an exchange with the environment took place. Lowering the temperature worsens the lubricating property and hence also the friction in the lubrication system. This problem can be solved in that a free piston is provided in the thermal reservoir, the thermal reservoir here preferably having a cylindrical form which divides the reservoir into two partial chambers that are connected to one another by switching valves, so that the preheated oil cannot become mixed with the incoming cold oil. The free piston keeps the volume of oil constant so that it does not have a disadvantageous effect on the pressure ratios and on the volume of oil in the lubricating circuit.

According to an advantageous development of the invention, the lubrication system, oil reservoir, structural environment and heat source can be enclosed within a combustion engine, in particular a combustion engine of a motor vehicle.

Alternatively or in addition to the above development, the lubrication system, oil reservoir and structural environment can be enclosed within a transmission, in particular a motor vehicle transmission, and the heat source can be provided by a combustion engine and/or by an electric battery and/or by an inverter. An inverter can convert DC electricity to AC and vice versa, and is used to power AC and three-phase drives by batteries. A lubricating medium in a transmission or in a mechanical power train can thus be heated by waste heat from a combustion engine or, for example when an electric or hybrid vehicle is used, by a heating property of a battery or of an electric consuming unit that becomes hot when releasing or receiving energy. It is also conceivable for a fuel cell, e.g. in the case of a hydrogen drive, to make a heat source available for heating the lubrication system for the drive mechanism/transmission.

Electric vehicles and hybrid vehicles that are driven by a combination of an electric motor and a combustion engine are confronted with the problem that they do not include an intrinsic heat source such as a combustion engine and nevertheless the lubricating property significantly falls, in particular at temperatures below 30° C., thus increasing friction and raising the energy consumption. Waste heat that is generated for example by an inverter, a fuel cell or an electric battery can be used for heating the lubricating oil quickly, or the waste heat from an electric unit can be used in order to reach an optimum lubricating temperature, in particular for a transmission. A cooling circuit can for example be provided that connects the transmission, inverter and battery in order to heat the transmission more quickly, or to heat transmission oil with a coolant/oil heat exchanger, and to cool the inverter or the fuel cell or the battery, whereby an improved efficiency, increased range and lower consumption can be achieved.

According to an advantageous development of the two above embodiments of the invention, a thermal reservoir can contain engine oil and transmission oil in one unit, and in particular comprise at least one chamber for engine oil and one chamber for transmission oil.

By a combined heat exchanger for engine oil and transmission oil, which in particular comprises separate chambers for both oil lubrication systems, a uniform tank volume can be provided, where the reservoir comprises a single high-quality insulation and only requires little installation space. This allows a high-quality insulated tank comprising vacuum insulation or filled with a phase change material to be provided for example, comprising in particular two chambers for the two separate lubrication systems. By their integration into a single unit, the total volume can be significantly reduced, in particular in the presence of critical space problems such as occur in a motor vehicle. Component costs can furthermore be saved, and a high-quality insulation for the entire unit can be used, entailing significantly lower costs and minimizing problems in the development of this kind of lubrication system.

According to a further advantageous development, the heat source in the case of a combustion engine can comprise an exhaust gas heat exchanger, or the heat source, in particular in the case of application in a transmission, can comprise a coolant heat exchanger and/or an exhaust gas heat exchanger of a combustion engine. In the case of a combination of coolant heat exchanger and exhaust gas heat exchanger, the exhaust gas heat exchanger can be arranged downstream of the coolant heat exchanger. A coolant valve can be arranged in the coolant circuit and is closed when the temperature falls below a coolant limit temperature, in particular below an opening temperature of the coolant circuit thermostat for the activation of a primary water cooler, in particular at most 10° C. below the coolant circuit thermostat temperature, and is opened when the coolant limit temperature is exceeded. The coolant valve can in particular be opened below the opening temperature of the coolant circuit thermostat, preferably below 5° C. under the opening temperature of the coolant circuit thermostat.

According to an advantageous development of the invention, the transmission can be a manual transmission or an automatic transmission that does not have an oil pump, wherein a coolant heat exchanger is arranged in the oil reservoir, so that the transmission oil is heated by the engine coolant. It is advantageous here that the coolant heat exchanger is provided on the coolant side with a coolant valve which is closed when the temperature falls below a coolant limit temperature, in particular below the opening temperature of a coolant circuit thermostat for activating the primary water cooler, in particular 10° C. or more below the coolant circuit thermostat temperature, and is opened when the coolant limit temperature is exceeded, in particular is opened below the opening temperature of the coolant circuit thermostat, and in particular is opened below 5° C. under the opening temperature of the coolant circuit thermostat.

A manual transmission or an automatic transmission of a vehicle can significantly lower the fuel consumption due to improved lubrication. The oil for lubricating the transmission can preferably be heated by a cooling circuit, wherein in particular under high stresses the oil temperature can be heated quickly, or an increased temperature caused by a high stress in the transmission can be cooled by the cooling circuit. It is also conceivable for the transmission oil and the coolant to be heated by an exhaust gas heat exchanger, as is for example described in SAE 2011-01-1171. If however a coolant heat exchanger is used directly for heating the transmission oil, this has the disadvantage that the coolant, due to its greater specific thermal capacity, heats up more slowly than the transmission oil, and friction and thermal losses in the engine, particular during the cold-starting phase, are made worse by this, so that the fuel consumption is higher than the advantage achieved by the exchange of heat between the coolant circuit and the transmission oil. The SAE 2011-01-1171 study has for example shown that the coolant temperature rises more slowly than the lubricating oil temperature inside an automatic transmission. In order to overcome this, it can be advantageous if, in addition to the improved insulation of the lubrication system, the exchange of heat between the coolant and the transmission oil is interrupted when the coolant temperature is lower than the switching temperature of a coolant circuit thermostat, whereby an external water cooler is switched in, and if the flow of coolant through the coolant/transmission oil heat exchanger is not opened until the coolant circuit thermostat temperature has been exceeded, meaning that the coolant has warmed up significantly, and in particular not until an exchange of heat from the coolant to the oil can take place, i.e. when the temperature of the coolant circuit is only slightly lower than the temperature of the coolant circuit thermostat. This ensures that a heat transfer, i.e. heating of the lubricating oil by the coolant circuit, does not take place until the coolant circuit has become correspondingly hot, i.e. cooling of the oil circuit only takes place when the vehicle has reached a warm-running phase.

According to a further advantageous development, it is possible in the case of a transmission lubrication system that the transmission is a manual transmission, and the oil pump function can be provided by the displacement action of a pair of toothed wheels, in particular of the final drive of the transmission. It can be advantageous here for an oil pressure line to be arranged on that side on which the two tooth faces move to engage with one another, and an oil return line can be arranged on that side on which the two tooth faces move away from one another.

In a manner similar to automatic transmissions, switching transmissions are also significantly more efficient and lower in consumption if the oil temperature of the transmission is raised. Typical switching transmissions do not however have a separate oil pump such as is for example present in automatic transmissions, so that oil in a switching transmission cannot be pumped through a heat exchanger, and an effective lubricant circuit is not present in switching transmissions. Additional electric oil pumps can be provided in order to provide an oil circuit, and in particular a thermal input from a heat source for the transmission lubrication, but this requires additional installation space, additional costs, and consumes more electrical energy, thereby cancelling out part of the fuel reduction arising from improved lubrication. For this reason, according to the advantageous further development, a lubrication circuit for a switching transmission is proposed in which a heat exchanger is linked to a cooling system that heats the oil in the oil sump of the manual transmission more quickly. In order to create an oil pump effect, an oil suction pipe that takes oil to the external oil heat exchanger can be arranged close to a toothed gear wheel, where the toothed wheels move towards one another and can thereby generate pressure that can be used for the oil pump effect. The return line from the oil heat exchanger can be provided at an opposite end of the final drive of the transmission, wherein toothed wheels move apart from one another, thereby generating a negative pressure, and an oil suction effect can be provided. In this way, an oil pumping effect for operating a lubricating circuit can be provided without additional expense, where a lower consumption can be achieved by an external heat source and by improved insulation of the lubrication system.

Blow-by gases are gases that can pass from the cylinder combustion chamber past the piston into the crankcase, and which should not be directly released to the environment in order to comply with appropriate exhaust standards. These gases are usually passed back into the engine intake air, and are not released into the environment without first being cleaned by a catalytic converter. The best known application here corresponds to what is known as positive crankcase ventilation, or PCV. A crankshaft exhaust gas opening is here coupled to the air intake of the engine, and a blow-by gas valve is provided that links the crankcase to a fresh air inlet, typically to an air filter. One disadvantage of this design is that fresh air penetrates into the crankcase, and the fresh air is in most cases colder than the temperature of the crankshaft, as a result of which the crankshaft accordingly cools down, causing the viscosity of the lubricating oil to rise and, in the cold-starting phase in particular, leading to higher friction and therefore higher fuel consumption occur.

According to an advantageous development, the heat source can comprise a connecting line of the exhaust pipe of a combustion engine to a crankcase or to an engine block, wherein the crankcase does not have a connecting line between the ambient air and the crankcase, so that the crankcase cannot be cooled down by the ambient air. More exhaust gas from the combustion engine thus flows through the crankcase. The entry of fresh air into the crankcase housing, which could lower a lubricating oil temperature, is thus prevented.

In many modern combustion engines, in particular those with turbocharging, piston spray cooling equipment is provided, in which an oil cooling jet sprays oil at high pressure from the crankcase or through an opening in the oil line in the connecting rod, onto the underside of the cylinder piston when high speeds of rotation or high loading phases occur, in order to prevent the engine oil located behind the piston ring from coking. In many cases, piston spray cooling is controlled depending on the engine oil pressure, so that at low oil pressures, for example lower than 2 bar, oil does not exit through the spray nozzles, and the mechanical power consumed by the oil pump is therefore reduced. Disadvantages here are that during a warm-running phase the oil pressure at the piston spray nozzles is relatively low, and piston spray cooling does not take place because of the low engine speeds. If, however, oil were to exit through the piston spray nozzles, faster heating of the oil could take place which, in combination with an improved insulation in which the oil gallery and the crankcase or the crankshaft are insulated, would lead to significantly improved oil heating. Since the openings of the cooling nozzles are relatively small, only a small proportion, normally less than 30%, of the total oil flow can pass through the piston spray nozzles while piston spray cooling is active.

According to a further advantageous development, the heat source can comprise piston spray cooling of a combustion engine, wherein a volume flow of oil sprayed by the piston spray nozzles onto the underside of the pistons of the combustion engine represents the largest volume rate of oil flow in the engine lubrication system, at least however 30% of the oil volume flow conveyed by the oil pump. In this case it is possible—assuming that a catalytic converter is provided—for the volume rate of flow of oil through the piston spray nozzles to be reduced as soon as the catalytic converter temperature is below a "light-off" temperature limit value, i.e. the activation limit temperature of the catalytic converter, and the piston spray nozzle volume rate of flow can be reduced, in particular reduced to zero, as soon as the oil pressure falls below a predefined limit. By an increase in the nozzle outlet cross-section to a value greater than normal, wherein a flow of oil through the piston spray nozzle outlet is greater than 30% of the total oil flowing through the oil pump, an efficient input of heat into the engine oil can be achieved with control of the quantity of oil flowing through the piston spray nozzles independently of the rotation speed of the engine. If the oil spray nozzles are open during a cold-starting phase, the oil can heat up more quickly if it is sprayed onto the underside of the piston, which represents the hottest part of the engine, and so permits significantly improved lubrication in the cold-starting phase.

By virtue of the above, there is provided a means for reducing the volume of flow of oil through the piston nozzles when the catalytic converter temperature is below activation limit temperature, for reducing the piston spray nozzle volume rate when the oil pressure falls below a predetermined limit, and for regulating the volume flow of the oil pump by increasing the conveying capacity of the oil pump to achieve an increased pumped value flow inside the thermal reservoir as soon as the outlet temperature of the thermal reservoir is below a predetermined oil outlet temperature of at most 90 degrees C. and an inlet temperature of the thermal reservoir is above a predetermined oil inlet limit temperature of at least 90 degrees C.

In a combustion engine, waste heat is passed in many cases through the cylinder walls to a water jacket cooling system, with the heat being passed through a water cooler of a coolant circuit. According to an advantageous development, the heat source can comprise at least a part of an oil line, in particular an uninsulated oil line between a combustion chamber of a combustion engine and a coolant duct. In particular, the oil line can be arranged between a cylinder bore of the combustion engine and a coolant duct in the upper region of the cylinder bore, wherein the distance between the lower end of the oil line and the upper end of the cylinder bore, which is sealed by the gasket of the cylinder head, is at most 50% of the piston stroke.

According to the above development, at least a part of the oil line, arranged between the combustion chamber and the coolant duct, is insulated on one side from the inside to the side of the coolant duct. The thermal conductivity of the one-sided insulation can be significantly less than the thermal conductivity of the structural environment, and is preferably at least less than 1 W/(m·K). The oil line can in particular run parallel to the central axis of the cylinder.

If oil channels are arranged between the inner wall of the cylinder and the water jacket cooling system, a variety of advantages can be achieved:

- If the oil has a higher temperature than the coolant, the cylinder wall temperature is increased, which significantly improves the combustion process and reduces heat losses through the cylinder wall.
- The oil acts as insulation, which additionally increases the temperature of the cylinder wall.
- The lubricating oil passing through is heated significantly more strongly, which lowers friction and reduces fuel consumption.

In combination for example with piston spray cooling and insulation of the oil galleries and the crankshaft, and in particular by the arrangement of a thermal reservoir, it is possible for example to dispense with an expensive exhaust gas oil heat exchanger.

If the oil ducts are arranged parallel to the central axis of the cylinder, they can be manufactured relatively easily, e.g. drilled subsequently, and it is not necessary to provide complex casting molds for the cylinder jacket for all-round ducts horizontal to the central axis, which entail the risk that delicate parts of the valve drive, such as the bearings or solenoid valves for the camshaft timer, can be damaged by residues of molding sand. Furthermore, effective heating can be achieved if the oil ducts are parallel, since the oil flows from the colder lower end to the hotter upper end region, so passing through a temperature gradient, and can accordingly be strongly heated. By a half-side insulation of the oil ducts with respect to the water jacket cooling system, the efficiency of the proposed measures can be significantly increased.

According to a further advantageous development, a thermal reservoir for the transmission oil can be included, which preferably has a chamber with a phase change material, and structurally integrates a coolant heat exchanger as one unit for heating the transmission oil with coolant.

The heat exchanger requires a large installation space, where, in a cold-starting phase, hot fluid stored in the tank is mixed with return fluid, so that the overall temperature inside the thermal reservoir is lowered, since the hot oil is replaced by cold lubricating oil. For this reason, complex oil ducts are provided in many thermal reservoirs in order to control the movement of the engine oil, as is for example described in DE 87108302 A.

It is advantageous to integrate a heat exchanger for at least two fluids in the thermal reservoir, which already has a large volume and appropriately good insulation. Exhaust gas and/or coolant in particular can be considered as the heat-releasing fluid, while engine oil and/or transmission oil may be considered as the heat-absorbing fluid. Preferably an exhaust gas/engine oil heat exchanger and a coolant/transmission oil exchanger may be considered, as well as a combination of these, e.g. a coolant/transmission oil/engine oil heat exchanger or an exhaust gas/engine oil/transmission oil heat exchanger. The at least two fluids can advantageously be coupled by a chamber with a phase change material. A phase change material helps to set a preferred coupling temperature and to store heat or cold. By absorbing heat from the heat-releasing fluid, the phase change material melts and the heat-releasing fluid is cooled. When the temperature falls, the phase change material freezes again by releasing heat to the heat-absorbing fluid, so that the latter is heated up. The result is storage of thermal energy, a delayed heat transfer and a preferred heat transfer temperature.

Based on the transmission lubrication system with the thermal reservoir, it is possible in a further advantageous development of the invention for the coolant heat exchanger structurally integrated with the thermal reservoir to be designed as a plate heat exchanger, wherein each of the two outer first plates carry coolant, and transmission oil is passed between the respective next second plates towards the inside, and a phase change material is arranged between the respective next third plate towards the inside, and engine oil is passed between the respective next fourth plate to the inside, wherein moreover preferably between a respective next fifth plate to the inside a phase change material is arranged and, in addition, transmission oil is passed between respectively a next sixth plate towards the inside and, moreover, coolant is passed between a respective next seventh plate towards the inside, wherein the sequence of further layers as given above can be continued as long as required. Alternatively, it is conceivable for the coolant heat exchanger to be designed as a tube heat exchanger, with for example coolant in an inner tube, transmission oil in an outer hollow cylinder concentric therewith, phase change material in a further concentric hollow cylinder, and engine oil in a further concentric hollow cylinder. If required, the concentric structure of the tube heat exchanger can be repeated, or the tube heat exchanger can take a meandering route.

By using a simple plate heat exchanger technology in which various fluids such as engine oil, transmission oil, coolant, phase change material are carried in different layers, wherein the hottest fluid is flanked by phase change material which is in turn flanked by transmission oil, and this in turn is flanked by coolant fluid, and the flow of all these fluids is controlled in such a way that the transmission oil stops flowing when an engine oil temperature falls below a predefined engine oil limit value, and the coolant fluid stops flowing when a coolant temperature falls below a predetermined limit value, improved warming up of the various lubricating oils can be achieved along with lower exhaust gas emissions and fuel consumption.

Based on the transmission lubrication system with the thermal reservoir, it is possible in an advantageous further development for one or more valves, in particular a coolant valve and/or a transmission oil valve to be provided for controlling the fluid flow through the various ducts of the heat exchanger, so that a supply of coolant is interrupted when the coolant temperature is lower than a first coolant limit temperature, in particular 90° C. and when the transmission oil temperature is higher than the coolant temperature, and that the supply of transmission oil is interrupted when an engine oil temperature is below a first engine oil limit temperature, in particular below 120° C.

Based on the transmission lubrication system with the thermal reservoir, it is possible in a further advantageous development for the supply of transmission oil to the thermal reservoir to be opened as soon as the engine oil temperature reaches a second heat exchanger/engine oil limit temperature, in particular greater than 120° C. The supply of transmission oil to the thermal reservoir can moreover be closed as soon as the engine oil temperature reaches a lower third heat exchanger/engine oil limit temperature, in particular lower than 90° C. In addition, a supply of cooling water to the integrated thermal reservoir can preferably be opened as soon as the transmission oil temperature is lower than the coolant temperature, and the supply of cooling water to the integrated thermal reservoir can be closed as soon as the transmission oil temperature is greater than the coolant temperature.

Exhaust gas/oil heat exchangers are relatively expensive and complex, since they must cope with high temperatures and high pressures, along with the risk of leaks and of catching fire. Expensive measures to prevent corrosion and contamination by the exhaust gases must be taken, and the accumulation of water that could freeze must be prevented. By a one-piece design of an exhaust gas/oil heat exchanger for engine oil and transmission oil in a single structural unit, wherein an exhaust gas bypass line is arranged with an exhaust gas bypass valve so that the passage of exhaust gas through the exhaust gas/oil heat exchanger can be switched when the engine oil temperature or the transmission oil temperature reaches a maximum, optimum control of the heating can be achieved, in particular under high stresses and during the cold-starting phase. In this way improved lubrication can again be achieved.

According to an advantageous development of the invention, an exhaust gas/oil heat exchanger for engine oil and transmission oil can be designed as one part. It can furthermore be advantageous for the heat exchanger to operate to the counter-flow principle, in particular for engine oil and transmission oil to pass through the heat exchanger in counter-flow, and preferably for the region of the transmission oil/exhaust gas heat exchanger to be arranged downstream, on the exhaust gas side, from the region of the engine oil/exhaust gas heat exchanger. The exhaust gas/oil heat exchanger can, on the exhaust gas side, be provided with an exhaust gas bypass line and at least one exhaust gas bypass valve, so that a flow of exhaust gas through the region of the engine oil/exhaust gas heat exchanger can be interrupted when a predefinable first heat exchanger/engine oil limit temperature, in particular of 120° C., is exceeded. The flow of exhaust gas through the region of the transmission oil/exhaust gas heat exchanger can be interrupted when a first heat exchanger transmission oil limit temperature, in particular 90° C., is exceeded.

By integrating the transmission and engine oil heat exchangers into one unit with one housing with a switchable exhaust gas bypass, heating/cooling of the oil can be controlled by affecting the flow of exhaust gas. Thus the flow of exhaust gas can be passed via the bypass line when the engine oil or the transmission oil has reached a limit temperature.

Conventional coolant has the disadvantage that there is a risk that coolant begins to boil at maximum temperatures in the combustion chamber, so that the combustion chamber wall temperatures have to be restricted in order to avoid individual components being thermally overloaded and to prevent local overheating or damage to the engine.

According to a further advantageous development of the invention, the coolant of the coolant circuit can comprise a phase change material having a melting temperature above 0° C. and a boiling temperature of at least 120° C., in which the density rises with rising temperature, in particular during the phase change from solid to liquid. The coolant circuit containing this phase change material can be integrated into the combustion engine to be cooled in such a way that there are no connecting lines leading to other components. A first coolant circuit with the phase change material can here be surrounded by a second coolant circuit and be cooled by it, wherein the second coolant circuit is filled with a coolant having a melting temperature of at least below −30° C., and the second coolant circuit can have components arranged outside the combustion engine, in particular a cooler.

A phase change material can provide a higher boiling temperature than water, so that the use of such material in the cooling system permits a higher peak temperature in the combustion chamber. Phase change material has however a low specific thermal capacity and a poorer thermal conductivity or both, so that large coolers, pumps and connecting lines are needed in the coolant circuit. It is furthermore not possible to use a phase change material that adopts a solid state at ambient temperatures between −40° C. and 0° C., since in the solid condition under high stresses no waste heat can be transported to the cooler. For this purpose, it is first necessary for the phase change material to melt, which is hard to achieve, in particular in those parts of the cooling system that are located outside the combustion engine, for example in the cooler. For this reason it is proposed according to the aforementioned embodiment that a phase change material with a melting temperature between 40° C. and 120° C. is used, and only within an internal cooling circuit, so that in a cold-starting phase the phase change material reaches its melting point very quickly and becomes liquid, and is already able to transport heat away during the cold-starting phase. The inner cooling circuit is connected to an outer cooling circuit by a heat exchanger, wherein conventional coolant for example with a melting temperature of below −30° C. can be used in the outer cooling circuit. In this way the advantage of an increased temperature in the interior is achieved, and stable, efficient cooling in a lubrication system with improved insulation can nevertheless be used.

A cooling system with separate cooling circuits for improved heating, wherein the coolant passes separately through a cylinder head and through a cylinder block, is known for example from the JSAE Review 23 (2002) pp. 507-511. During a warm-running phase, the coolant circuit through the cylinder block or engine block for example can be interrupted, wherein at higher temperatures the coolant flows through the cylinder head in parallel through the cylinder block, reaching the water cooler from there. This does however have the disadvantage that during a cold-starting phase, coolant in the cylinder block does not move, and local overheating can then occur, in particular under high engine load during the cold start. Additionally, as a result of convection the coolant is moved disadvantageously in that with a combined flow through the cylinder head to the cylinder block it flows from the top downwards, and hence opposite to the direction of convection, i.e. to the heat flow, which acts from the bottom upwards, so increasing the flow resistance at the engine pump and entailing additional mechanical stress and additional electrical consumption by the water pump.

According to an advantageous development, a cylinder head coolant duct and a cylinder block coolant duct of the cooling circuit of a combustion engine can be designed separate in order to speed up heating of the coolant. Here, during a warming-up phase below a first coolant limit temperature, in particular below 90° C., a coolant first flows through the cylinder head to be heated and from there through a cylinder/engine block, wherein the hot coolant heats up the cylinder wall, in order to reduce wall heating losses, and is passed from there to a coolant pump. When the first coolant limit temperature is reached, a first coolant flow direction thermostat in the cylinder head can be opened, and at least a part of the flow of coolant can be passed to a cooler. When a second coolant limit temperature, in particular above 100° C., is reached, a second coolant flow direction thermostat, in particular a 3-way thermostat at the former outlet of the cylinder/engine block, can close a connection to the inlet of the coolant pump and make a connection to the outlet of the coolant pump, so that the coolant in the cylinder/engine block flows in the opposite direction to that of the coolant in the cylinder head, and the combined coolant flow is passed through the cooler from the cylinder head and the cylinder/engine block.

Accordingly, in the proposed embodiment, the coolant is first routed through the cylinder head, wherein at the end of the cylinder head the coolant is passed back into the engine block, so that the cylinder block is also warmed up by the coolant already heated in the cylinder head, and therefore an improvement in the combustion process takes place, since the cylinder head typically warms up significantly more quickly and is hotter than the cylinder block—also in part because the water jacket cooling in the cylinder head takes up significantly less space and hot exhaust gases are also routed through the cylinder head—so that the largest amount of waste heat is generated there. In a further step, the coolant can heat up more quickly. When the coolant is hot enough, a coolant thermostat can change the direction of the flow of coolant in such a way that coolant flows through a water cooler, and when the engine block is hot enough, the coolant can flow in parallel through the engine block and the cylinder head, so that maximum cooling can be provided by the water cooler. In this way, adequate cooling and fast heating, or an even heating of the engine block, is achieved, so that the lubricating oil is heated up more quickly.

In a further embodiment of the lubrication system, it is proposed that the piston of a combustion engine on the inside of at least one piston skirt is insulated by an insulation, wherein the thermal conductivity of the insulation is 5% or less than the thermal conductivity of the piston skirt, and preferably less than 1 W/(m·K), wherein preferably the inside of the piston head is not insulated. An insulation of an oscillating component to be lubricated is thus proposed, so that the piston skirt facing a cold cylinder side wall during the cold-starting phase is insulated, although the piston head, which heats up quickly, is not insulated. In this way, an additional quantity of heat is provided for the oil, and an insulation to prevent cooling relative to the cold cylinder block is achieved. A piston insulated in this way for fast heating is particularly advantageous with piston spray cooling, in which a large quantity of oil comes into contact with the piston head.

If a thermal reservoir is provided in order to store oil temporarily in a desired temperature range, an exhaust gas heat exchanger can advantageously be provided for heating or cooling, and designed with at least three volumes or three ducts or with three chambers, and which can be structurally integrated into the heat exchanger. The exhaust gas heat exchanger can comprise a first volume through which at least a first portion of the exhaust gas can flow, wherein the first volume is bounded by a first separating wall or surrounded by a first separating wall, wherein on at least one of the sides of the first separating wall not in contact with the proportion of exhaust gas flowing through a phase change material can be arranged in a second volume, which is bounded by a second separating wall or is surrounded by a second separating wall, wherein on at least one of the sides of the second separating wall not in contact with the phase change material lubricating oil can flow through a third volume. An arrangement sequence of first, second and third volumes or ducts in the opposite sequence (i.e. e.g. the sequence: first volume, second volume, third volume, second volume, first volume, second volume, third volume etc.) can be repeated at least once, and in particular more than once. The phase change material can comprise at least a sugar alcohol such as erythritol, threitol or a paraffin, or a salt such as a hydrate, nitrate, hydroxide or a chloride such as magnesium chloride hexahydrate or magnesium nitrate hexahydrate, whose latent heat of fusion is greater than the heat that the thermal reservoir can store on the basis of the temperature difference between a first lower oil limit temperature of 50° C. and a first upper limit temperature of 90° C. Advantageously, the melting temperature of the phase change material can be lower than the first upper oil limit temperature and preferably, provided the melting temperature of the phase change material is greater than 100° C., the phase change material is erythritol with a melting temperature of about 120° C., so that the highest possible temperature is present in the thermal reservoir during a cold start. By a three-chamber heat exchanger of this type, integrated into the thermal reservoir, with an indirect coupling between the oil and the exhaust gas through a phase change material, a direct heat transfer from very hot exhaust gas to oil is avoided, since the phase change material acts as a heat buffer. This avoids local overheating of the oil by the phase change material (PCM) as a cushioning layer. In addition, the insulation and sealing are increased, so that direct contact between oil and exhaust gas is prevented. The PCM material, for example magnesium chloride hexahydrate ($MgCl_2 \times 6H_2O$), is noncombustible and therefore reduces the risk of fire. The exhaust gas heat exchanger can be simply designed as a plate heat exchanger, and integrated into the thermal reservoir. The insulation of the thermal reservoir insulates the heat exchanger, so that this can ensure an effective heat transfer very quickly during a cold start, without the need for the exhaust gas to heat the walls of the heat exchanger itself.

The aforementioned heat exchanger can preferably be designed as a tube heat exchanger with at least three tubes inserted into one another. The tubes can thus have a double-wall structure, and a phase change material can be arranged in the intermediate space between the inner tube and the outer tube. This allows a separation, compact construction and simple manufacture to be easily achieved. If a leak does occur, it would be ensured that no liquid could escape into the thermal reservoir, since a leak could only penetrate no further than a PCM chamber.

In an advantageous development of the aforementioned implementation with a thermal reservoir with integrated exhaust gas/oil heat exchanger, at least one of the exhaust gas connecting lines of the exhaust gas heat exchanger integrated into the thermal reservoir can be insulated from the thermal reservoir by a ceramic line. This further improves the insulating effect, and so reduces heat losses.

In an advantageous development, an oil feed line of a cylinder head and/or of a turbocharger can be connected downstream before the heat source to a cylinder block-oil gallery. A coolant heat exchanger can furthermore be arranged in the oil feed line of the cylinder head and/or of the turbocharger, through which coolant of a coolant circuit can flow. By routing the cylinder head and turbocharger oil feed line downstream before the heat source, the oil temperature in the cylinder head and turbocharger can be kept at a low level, since the oil has the lowest possible temperature before being heated by the heat source. As a result, friction in the valve drive is reduced in the cylinder head, since a mixed friction is avoided, in particular when the speeds are low in the valve drive. The risk of oil leaks in the suction side of the turbocharger is reduced, so that a tendency to glow ignition by oil particles is reduced, in particular in petrol engines with direct injection.

In a further advantageous embodiment, a volume flow of the oil pump can be regulated, wherein a conveying capacity of the oil pump is increased in order to achieve an increased pumped volume flow inside a thermal reservoir, as soon as an oil outlet temperature of the thermal reservoir is below a predefinable oil outlet limit temperature of at most 90° C., and an oil inlet temperature of the thermal reservoir is above a predefinable oil inlet limit temperature of at least 90° C. It has been found that in the case of a relatively high oil temperature in the oil circuit as referred to above, very little of the cold oil is displaced by the incoming hot oil, since the hot oil flows like a short circuit through the cold oil. For that reason, in the case of a hot oil, in particular in a hot phase, it is advantageous to increase the speed of oil flow by increasing the pump conveying capacity in order to generate a higher flow speed of the hot oil and hence a turbulent flow, wherein the cold oil with its laminar flow is displaced better.

DRAWINGS

Further advantages emerge from the following drawing description. Exemplary embodiments of the invention are illustrated in the drawing. The drawing, the description and the claims contain many features in combination. The person skilled in the art will also consider the features individually, and combine them into useful further combinations.

Figure 2:
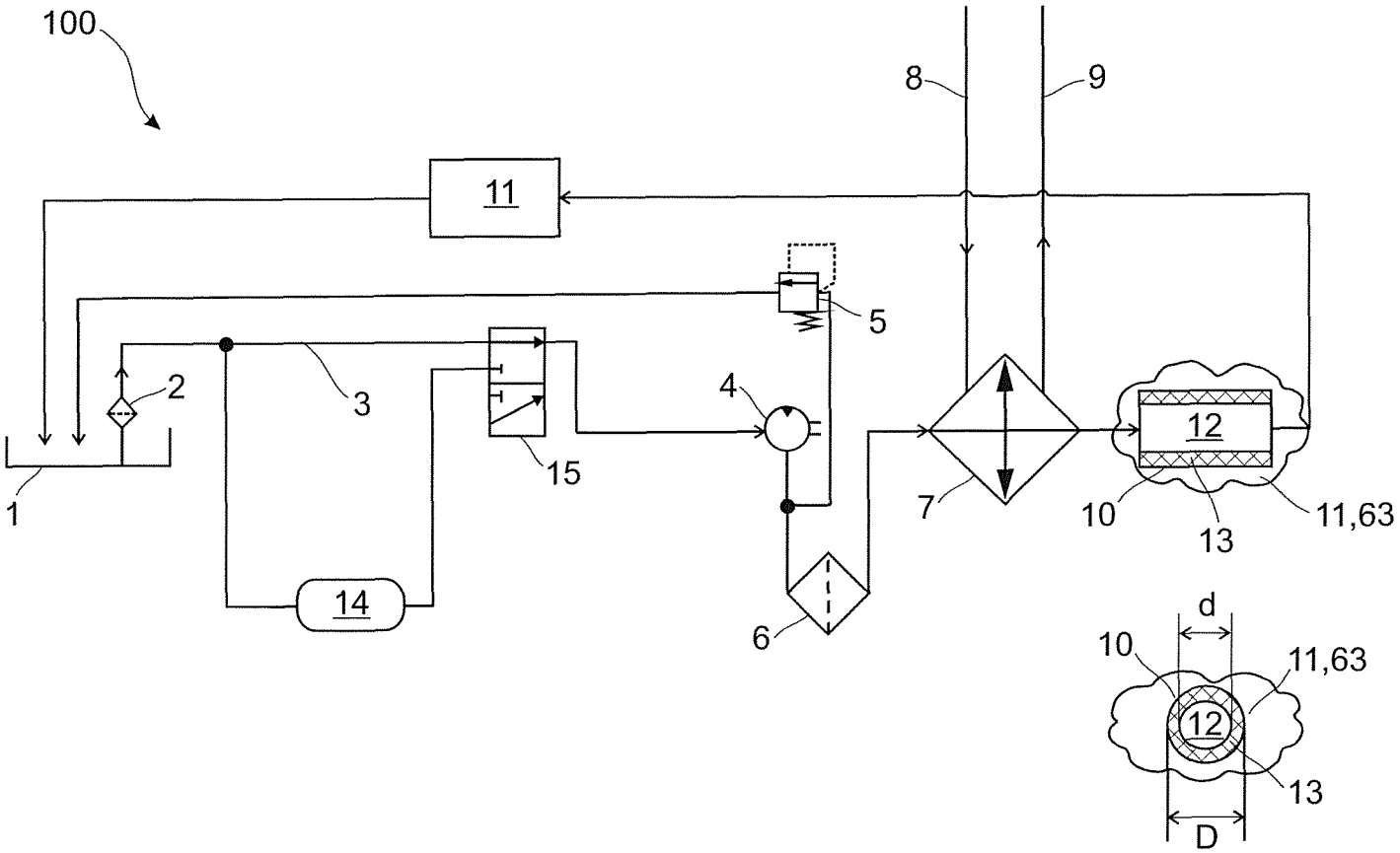
Figure 3:
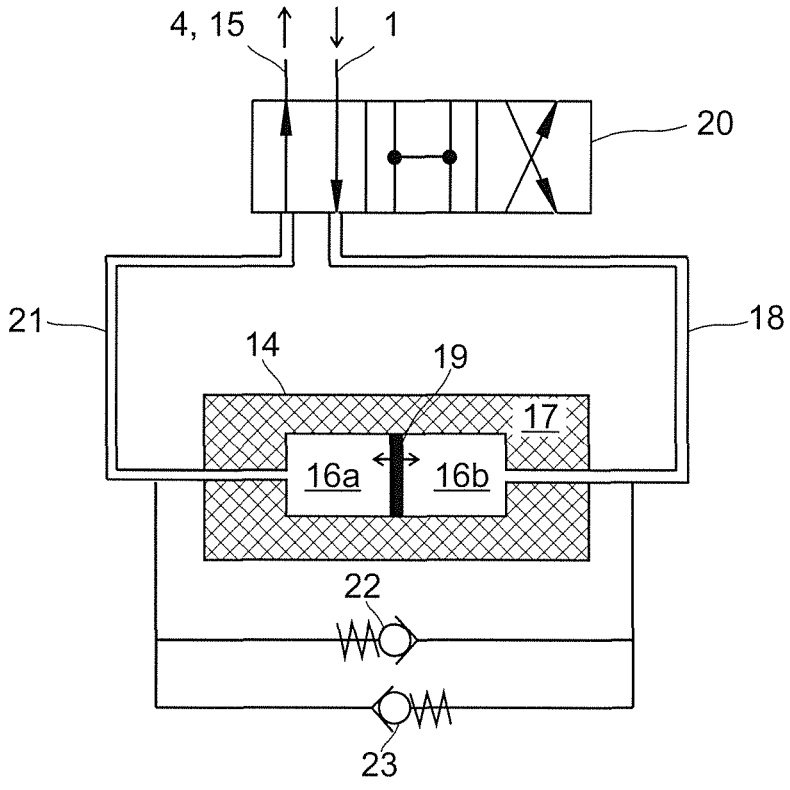
Figure 4:
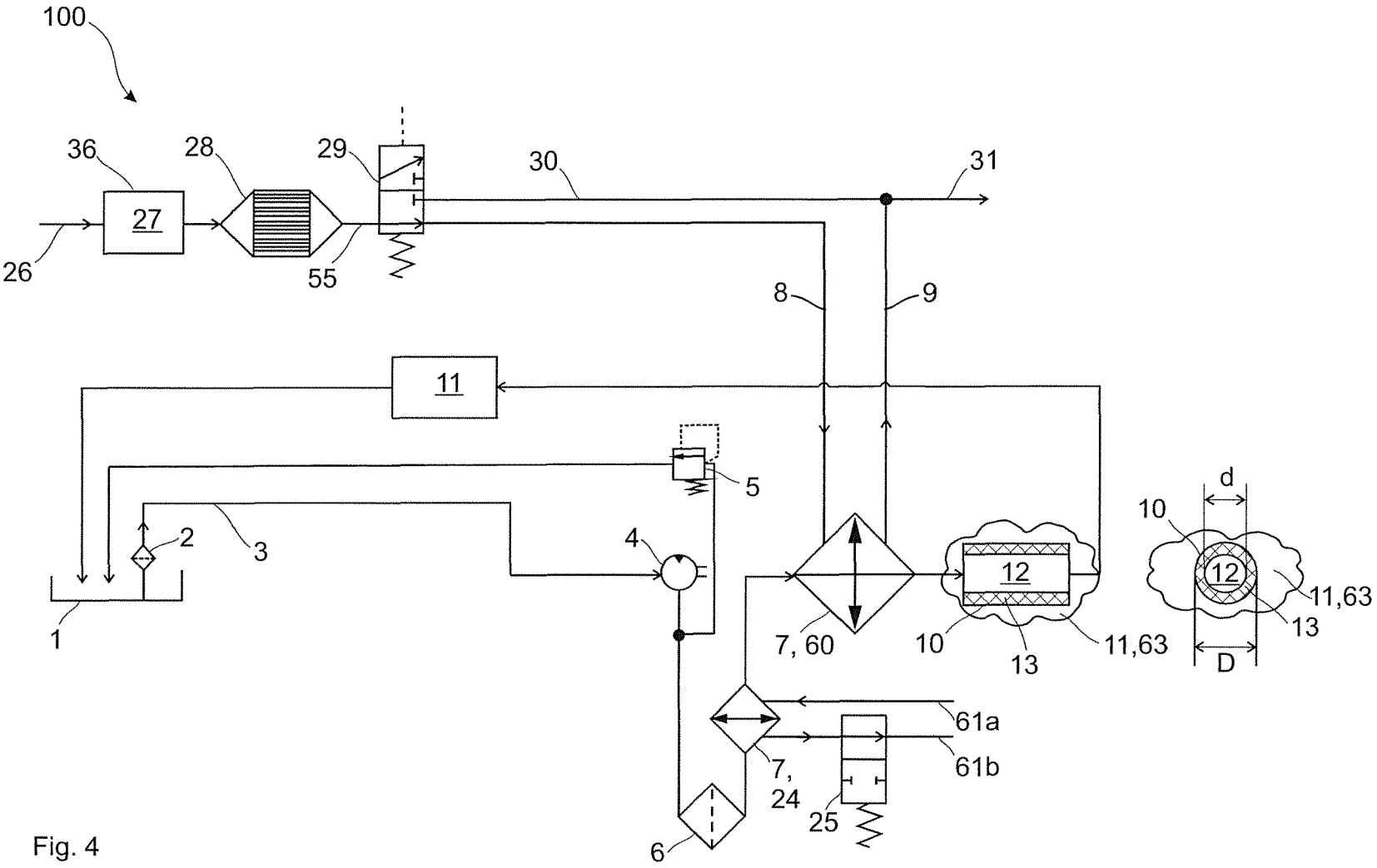
Figure 6:
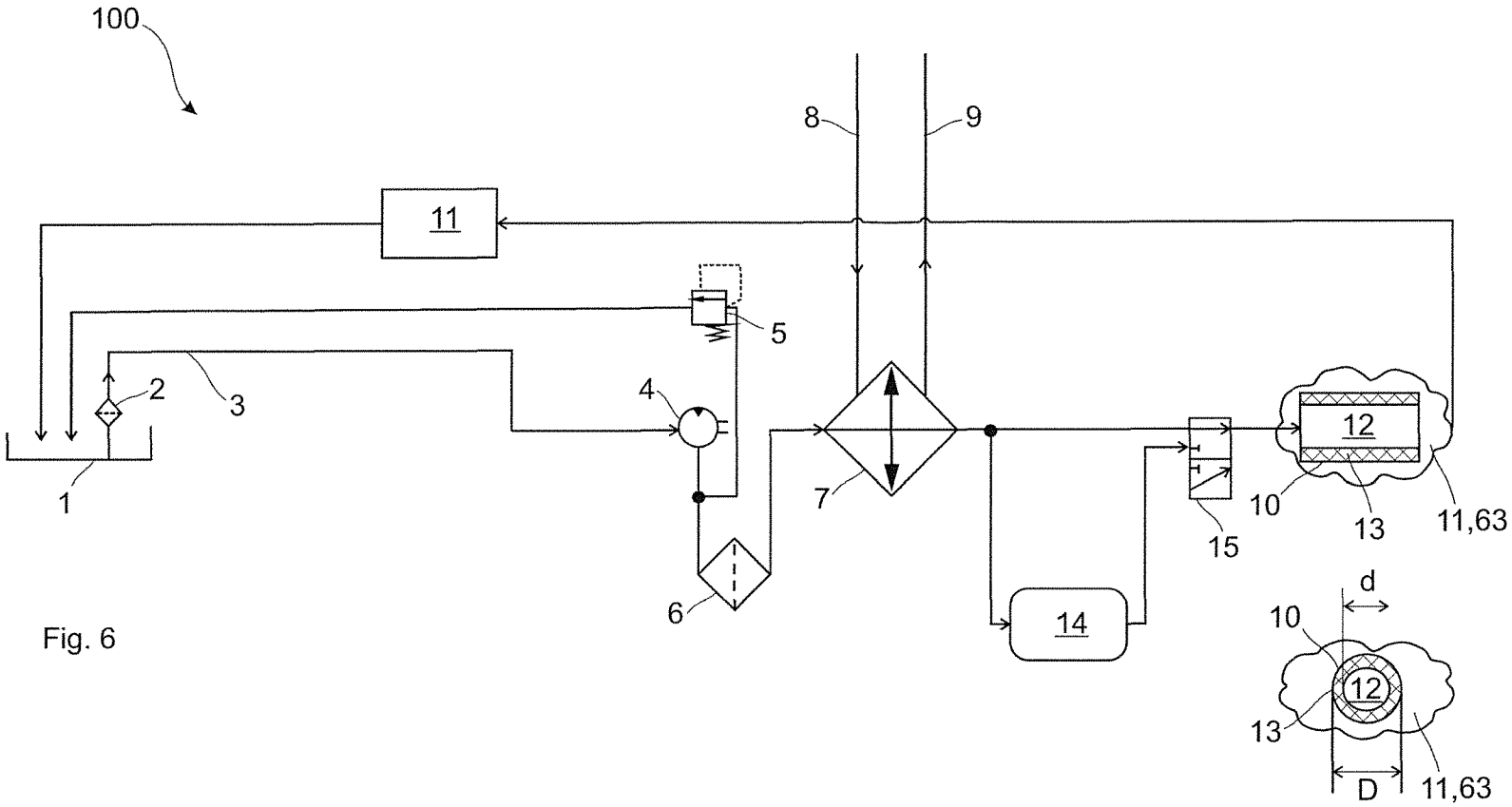
Figure 8:
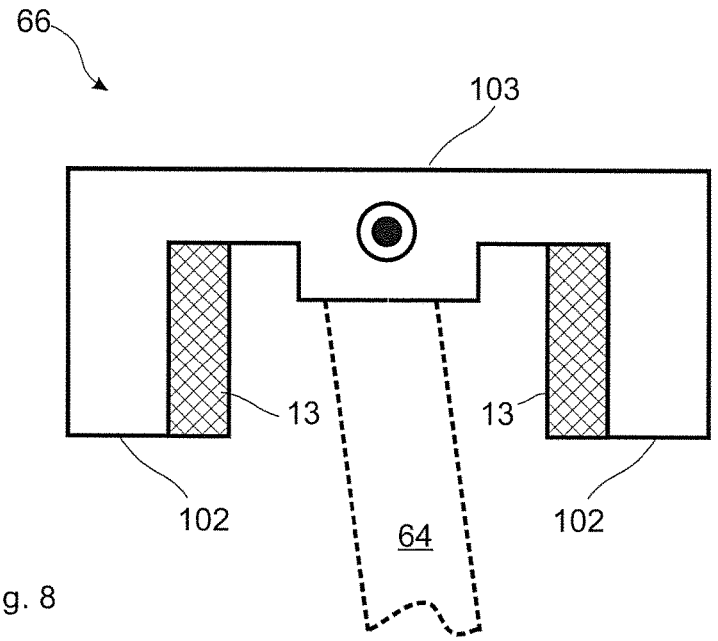
Figure 9:
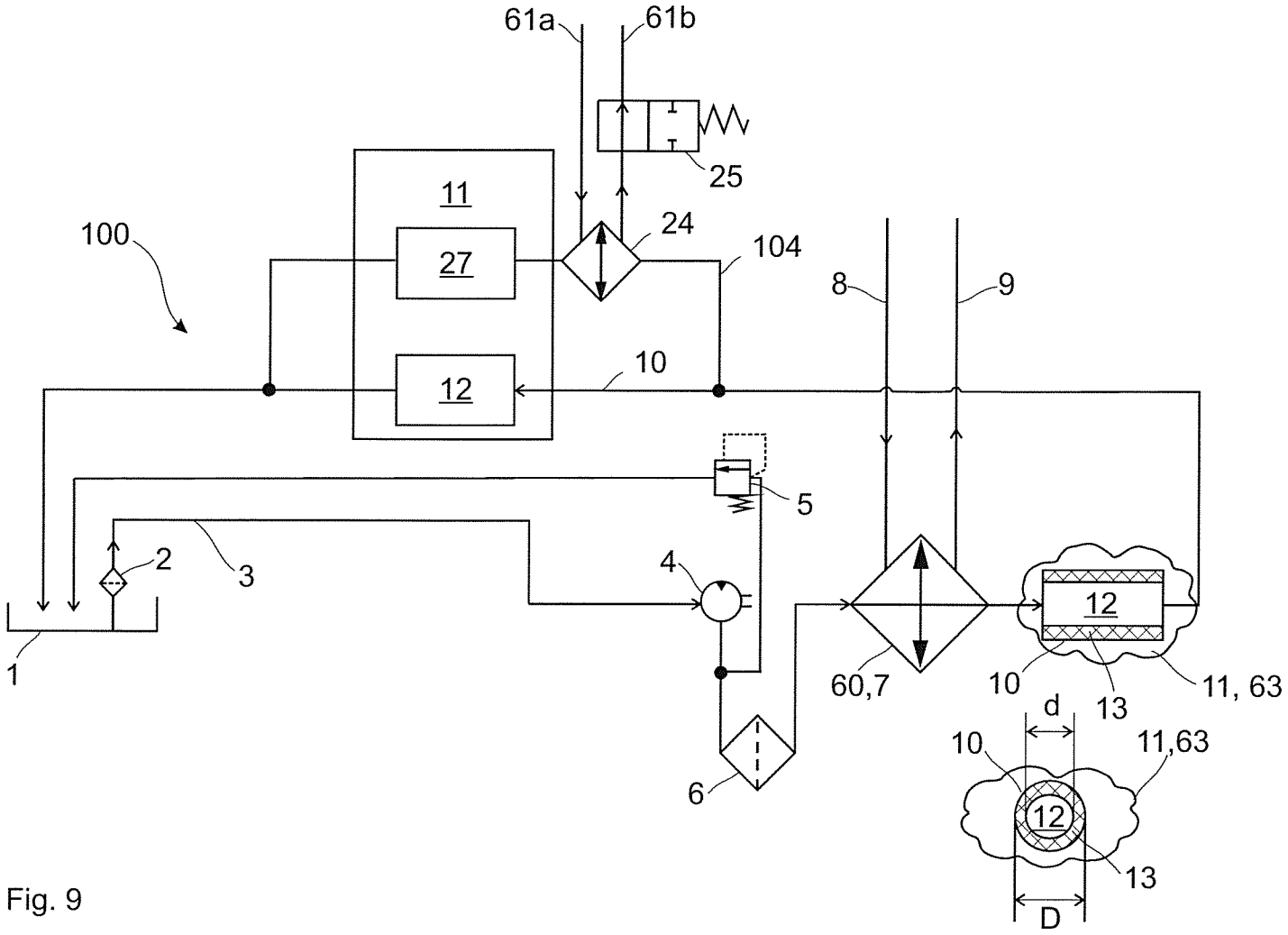

The figures show in:

FIG. 1 a first exemplary embodiment of a lubrication system in accordance with the invention;

FIG. 2 a second exemplary embodiment of a lubrication system in accordance with the invention;

FIG. 3 an exemplary embodiment of a thermal reservoir for a lubrication system in accordance with the invention;

FIG. 4 a further exemplary embodiment of a lubrication system in accordance with the invention;

FIG. 5 an exemplary embodiment of an oil lubricating line routing in the cylinder head of a combustion engine for an oil lubrication system in accordance with the invention;

FIG. 6 a further exemplary embodiment of a lubrication system in accordance with the invention;

FIG. 7 exemplary embodiments of a coolant circuit for use in lubrication system in accordance with the invention;

FIG. 8 exemplary embodiments of a partially insulated piston of a combustion engine for use in a lubrication system in accordance with the invention;

FIG. 9 a further exemplary embodiment of a lubrication system in accordance with the invention.

Components that are identical or of the same type are given the same reference character in the figures.

FIG. 1 shows a first exemplary embodiment 100 of lubrication system in accordance with the invention for a functional structural environment 11, in particular for lubrication points such as oil gallery, crankshaft, bearing or a metal structural environment 63 such as transmission components with a metal surrounding and housing. A lubrication system of this type can for example be used in a vehicle with a combustion engine, an electric vehicle, or a hybrid vehicle. A crankcase can be considered by way of example, in which the crankshaft, bearing shell, connecting rod and housing form a metal environment, whose high specific thermal conductivity draws heat out of the oil at low ambient temperatures. Internal insulation of these areas, in particular areas that have contact with the outside air, can accelerate heating of the oil.

In FIG. 1, lubricating oil is stored in an oil reservoir 1, from which it is extracted through an oil sieve 2 and an electrically operated pump 4. To avoid excess pressure, an overpressure valve 5 is arranged after the pump outlet and allows oil to pass back through the pump 4 into the oil reservoir 1 in the event of excessive pressure in the oil lubrication circuit. The oil is passed through another oil filter 6 and through a heat source 7, in this case an exhaust gas/oil heat exchanger, which comprises a feed line for thermal energy 8 and an outlet line 9 of the residual energy flow. These can for example be a feed pipe and an outlet pipe between a catalytic converter of a combustion engine and the exhaust. Alternatively, the heat source 7 can also be a heat exchanger between the oil lubrication system and coolant circuit, whereby the lubricating oil can be heated up more strongly during a cold-starting phase. Following the heat source 7, at least one connecting line with lubrication points 11 or oil gallery line 10 is connected, supplying the sites to be lubricated with lubricating oil, and comprising an internal thermal insulation 13, within which is routed an oil-carrying inner part 12 of the oil gallery 10. The outer diameter D is thus significantly smaller than the inner diameter d, since the insulation is aligned towards the inside and reduces the cross-section, so that the ratio of surface to volume is improved and the loss of heat energy to the metal environment or the structural environment 11, 63 is reduced. In addition, internal housing walls, oscillating components or other metal areas that come into contact with the lubricating oil are provided with an insulating layer. After the oil, which has been heated by the heat source 7, has passed through an insulated environment to the locations to be lubricated, the oil is returned to the oil reservoir 1, where it is available for another passage through the circuit. By thermal insulation of the oil gallery 10, lubrication points 11 and structural environment 63 following the heat source 7, the loss of thermal energy to the metal environment, such as the cylinder head or cylinder block, is significantly reduced, so that when warming up in a cold-starting phase, a low viscosity and therefore a reduced friction can be achieved, resulting in a reduced fuel consumption and reduced exhaust gas emissions from the combustion engine. In the case of a transmission, the structural environment 11, 63, can be the oil reservoir and transmission sump with transmission housing, and achieves a smoother action of the power transmission. In addition, the oil reservoir 1 can be thermally insulated, and further parts, such as the rotating or oscillating components to be lubricated, and their surrounding housing, can be insulated. Advantageously, a large proportion of the regions following the oil pump 4 are thermally insulated, in particular that part of the oil circuit that is under pressure, and the regions in which the heat is supplied from the heat source.

On the basis of the exemplary embodiment illustrated in FIG. 1, FIG. 2 shows a development of a lubrication system in accordance with the invention that builds on the structure of the lubrication system 100 of FIG. 1, and can be employed in a comparable manner. In addition to the configurations illustrated in FIG. 1, a thermally insulated heat exchanger 14 is arranged in the oil suction line 3 between the oil reservoir 1 and the oil pump 4, which is connected in parallel to the oil suction pipe 3 and which can be connected via a three-two-way switching valve 15 in the oil suction pipeline 3. In the thermally insulated thermal reservoir 14, oil can be temporarily stored in a heated state, in order to retain the heat and the lowered viscosity associated with it, so that improved heating is permitted in the thermally insulated structural environment, such as lubrication points 11 and the metal environment 63 such as the housing, components and so forth. It is possible, for example during a cold start, for oil having residual heat and therefore a lower viscosity than the oil in the oil reservoir 1, which adopts the ambient temperature, to be drawn from the thermal reservoir 14. A thermal reservoir 14 of this type can be designed with a high degree of insulation, for example vacuum-insulated, and when oil flows out it is mixed with fresh, incoming cold oil, and the mix temperature of the oil in the thermal reservoir 14 drops.

In order to further improve an external reservoir, for example as illustrated in FIG. 2, a highly thermally insulated thermal reservoir 14, as illustrated in FIG. 3, can be used, comprising a free piston 19 dividing the cylindrically designed thermal reservoir 14 into two movable large chambers 16*a* and 16*b*. Cold oil can for example flow into the chamber 16*b*, and hot oil can be stored in the chamber 16*a*. When hot oil 16*a* is withdrawn, the thermally insulated free piston moves to the left, and cold oil can flow into the chamber 16*b*, so that the pressure ratios in the thermal reservoir 14 remain constant. A four-three-way valve 20 allows different operating modes to be set up for the thermally insulated or oil reservoir 14. Thus a withdrawal position can be set in the left position, a connection of the two chambers can be set in the middle position, and on the right a loading position can be set in which the chamber 16*a* is filled with oil from a heat source 7, and oil from the chamber 16*b* can be released back into the oil reservoir 1. To prevent excess pressure, the two chambers are connected with pre-tensioned non-return valves 22, 23, so that an excess pressure in one channel can be relieved in the other chamber. The insulation 17 can be implemented very elaborately, for example as vacuum insulation, so that a temperature loss from for example 100 to 80° C. at an ambient temperature of 25° C. takes more than 6 hours to occur. This ensures that, at least when a vehicle is left for a short period of less than 24 hours, a sufficient quantity of hot lubricating oil is available to enable optimum lubrication even in the cold-starting phase.

FIG. 4 shows a further exemplary embodiment 100 of the lubrication system for a combustion engine which corresponds in principle to the structure of the lubrication system 100 illustrated in FIG. 1. In addition to the embodiment of FIG. 1, a further heat exchanger 24 is provided as a coolant heat exchanger, which is switchably connected to a coolant circuit 61 via a two-two-way valve 25 between the oil filter 6 and the heat source 7, which is designed as an exhaust gas heat exchanger 60. Heat can be input to the heat source 7 either via the coolant circuit 61 or via the exhaust gas heat circuit. A fuel-air mixture enters a cylinder head 27 of an engine block 36 through a suction line 26, after which the waste gas is routed via a catalytic converter 28 into an exhaust line 55. A three-two exhaust gas bypass valve 29 is arranged in the exhaust line 55, by means of which the flow of exhaust gas can be passed either through the exhaust gas/engine oil heat exchanger 7, 60 or can instead pass via an exhaust gas bypass line 30 directly to the exhaust pipe 31, in particular when a minimum oil temperature has been reached. In this way, via the two switching valves, the coolant valve 25 which is arranged in the downstream direction from the oil reservoir 1 in the oil circuit, and the exhaust gas heat exchanger 7, 60, which is arranged upstream in the direction of the oil gallery 10 and the components 63 and lubrication points 11 to be lubricated, heat can be supplied to the engine oil, so that heated and therefore highly fluid oil can be distributed through the highly insulated oil gallery into the structural environment 11, 63 to the point requiring lubrication before the oil is returned to the oil reservoir 1.

Figure 5C:
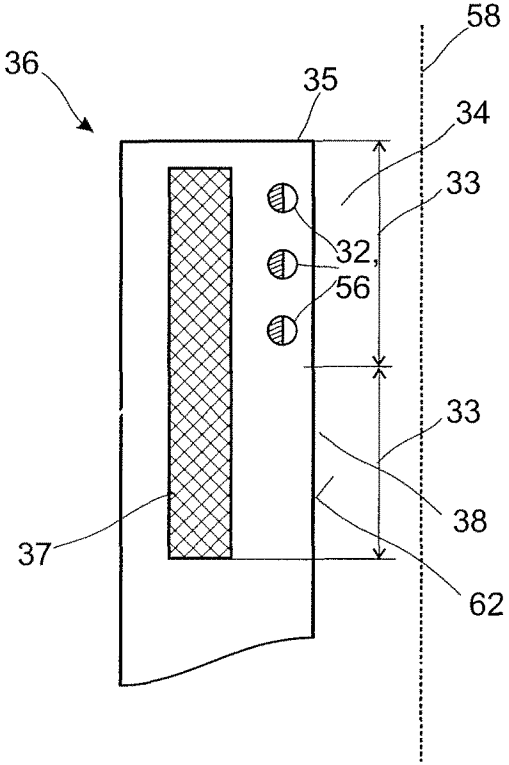
Figure 5B:
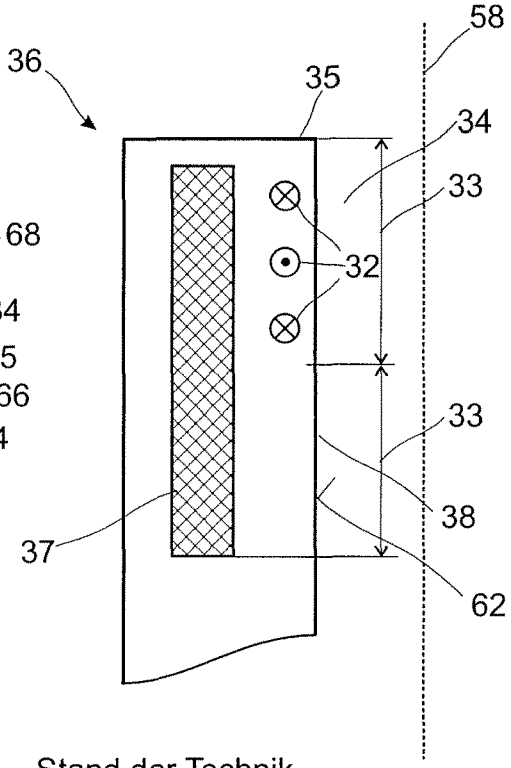
Figure 5A:
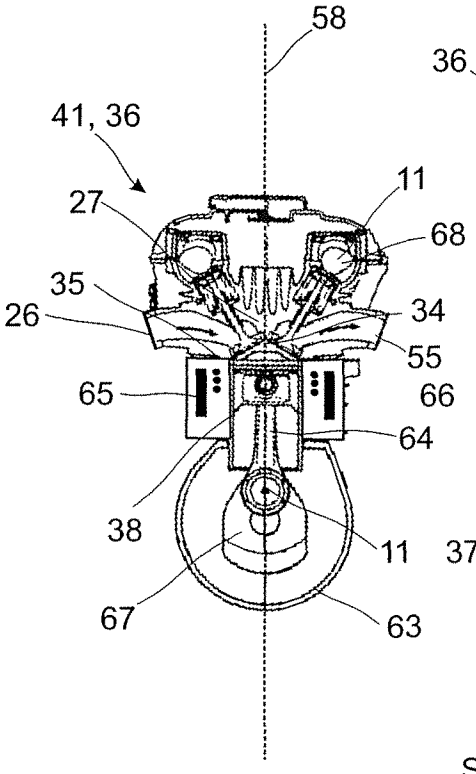

FIG. 5*a* illustrates schematically a combustion engine 41 with an engine block 36 and components such as cylinders with crankshaft 67, connecting rod 64 and piston 66, as well as a cylinder block and cylinder head 27 with inlet and outlet valves. The engine block 36 has a cylinder central axis 58, wherein the cylinder head 27 comprises a cylinder head flange 35 and a combustion chamber 34 while the engine block comprises a cylinder bore 38 in which the connecting rod 64 connects the crankshaft 67 to the piston 66. The cylinder jacket has a water jacket cooling system 65 with duct 37 for coolant, illustrated for example as coolant duct 37 in FIG. 5*b*.

In FIGS. 5*b* and 5*c*, only two exemplary embodiments of the oil routing line of a lubrication system 32 are illustrated, running in the upper region of the combustion chamber 34, at the level of half the cylinder stroke 33 between the outer and inner cylinder wall 62 and the coolant duct 37 of the water jacket cooling system 65. The combustion chamber 34 is located in the upper region of the half cylinder stroke in the cylinder, and represents the component in the combustion engine 41 that heats up most quickly, allowing lubricating oil to be heated particularly effectively there, and it can serve as the heat source 7 for improved lubrication, particularly during a cold-starting phase. FIG. 5*b* here shows uninsulated oil lines 32 that can absorb the heat of the cylinder wall and thermally insulate the combustion chamber 34 from the coolant duct 37. FIG. 5*c* illustrates a further embodiment showing an oil line 32, 56, insulated on one side, wherein the oil routing line is insulated on one half-side with respect to the coolant duct 37, and thus can heat up more quickly and offer a better insulation of the cylinder wall 62 from the coolant duct 37, while heat of the inside cylinder wall 62 can be transferred into the oil.

Based on the embodiment of FIG. 1, FIG. 6 shows a further lubrication system 100 which, in addition to the component shown in FIG. 1, comprises a highly insulated thermal reservoir 14 in the pressurized region of the oil lubrication line following the heat source 7, and is arranged before the thermally insulated structural environment 11, 63 with the oil gallery 12. Heated oil can be taken switchably through the three-two-way valve 15 into the thermal reservoir 14, and can be released again when needed, e.g. in the cold-starting phase. In contrast to the embodiment illustrated in FIG. 2, the thermal reservoir 14 is arranged in the pressurized region of the oil lubrication system 100, so that, in particular when starting up after being stopped for just a short time of at most one or two days, highly fluid and hot oil which does not first have to be heated by a heat source 7 is available for lubrication. In contrast to the thermal reservoir 14 illustrated in FIG. 2, the thermal reservoir 14 shown in FIG. 6 is designed for high pressures, and can have a different design.

FIG. 7 shows a coolant circuit 61 in which coolant can be passed through a combustion engine 41 along two coolant ducts 37, through a cylinder head 27, and through an engine block/cylinder block 36. The heat of the coolant circuit can be passed via a cooler 45 to a second coolant circuit 57 or to a flow of air. A coolant pump 39 forces the coolant to circulate in the coolant circuit 57, and two switching valves, namely the two-two coolant flow direction thermostat 44 and the three-two coolant flow direction thermostat 40, determine the direction and type of the flow of coolant through the cylinder head 27 and the engine block 36.

Figure 7A:
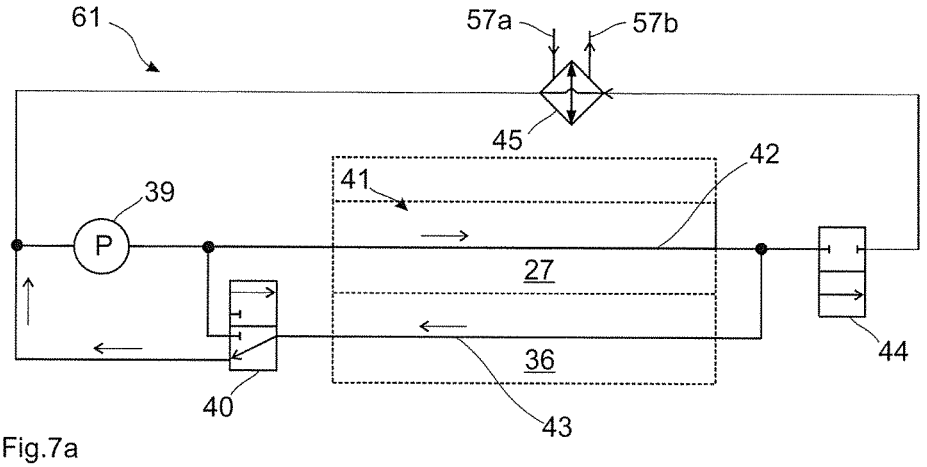

FIG. 7*a* shows that for example in a cold-starting phase, the coolant flows via the coolant pump 39, first through the cylinder head 27 and, when the coolant flow direction thermostat 44 is closed, back through the engine block 36, so that a closed circuit is formed in which no external cooling takes place, and the coolant flows anti-parallel through the coolant ducts 37 of the cylinder head 27 and the engine block 36.

Figure 7B:
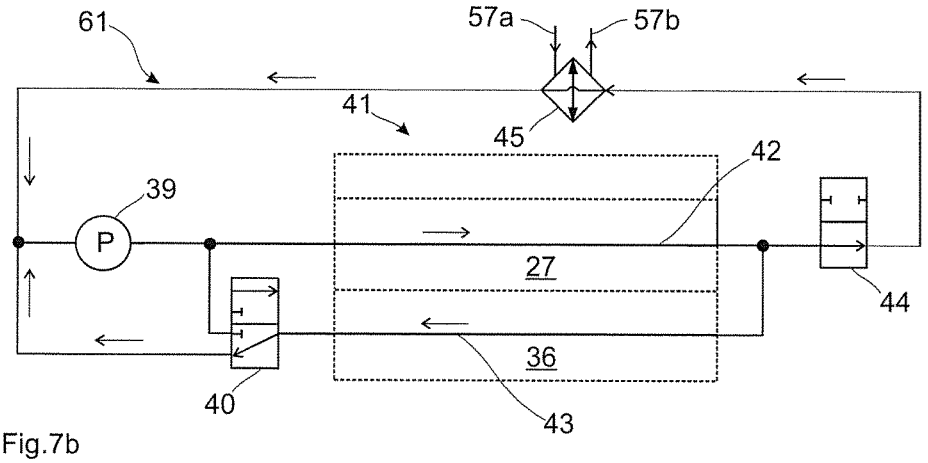

FIG. 7*b* shows a second switching possibility for a partial load region in which, firstly, the coolant flows through the cylinder head 27, after which it branches anti-parallel through the engine block 36 back to the coolant pump 39, as well as partly through a water cooler 45, whereby the cylinder head 27 can be well cooled while the engine block 36 can be cooled less.

Figure 7C:
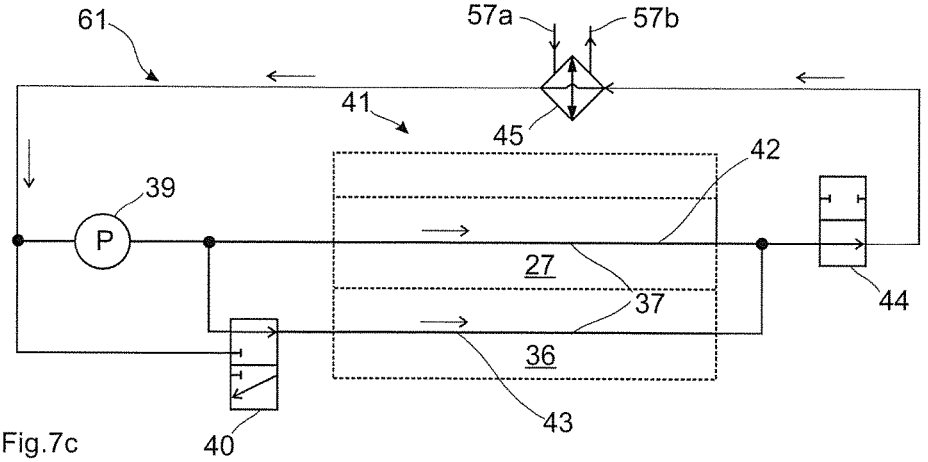

FIG. 7*c* shows a third switching variant for operation under full load, wherein the first coolant direction thermostat 44 is open and the second coolant direction thermostat 40 is also open, so that the coolant can flow in parallel through the cylinder head 27 and the engine block 36, so that maximum cooling capacity can be made available. The three configurations shown in the switching variants in FIGS. 7*a*, 7*b* and 7*c*, can be activated during different loading phases or cold and hot starting phases of a combustion engine, where FIG. 7*a* can be used for fast heating during a cold warm-up phase. FIG. 7*b* illustrates a lower cooling effect in a medium operating phase, while FIG. 7*c* shows a cooling circuit with a maximum cooling effect, so that the oil of a lubrication system can be quickly heated up under all load conditions, and can achieve a low viscosity and optimum lubricating effect.

FIG. 8 furthermore shows a piston 66 of a combustion engine 41 comprising an annular insulation 13 on the inside of the piston skirt 102 which thermally insulates the piston skirt 102 from the inner cylinder wall 62. The thermal conductivity of the insulation 13 is 5% or less than the thermal conductivity of the piston skirt 102. In contrast to the piston skirt 102, the inner side of the piston head 103 is not insulated. As a result, the piston head can heat up quickly during a cold-starting phase, wherein when piston spray cooling is used, for example, oil that is sprayed onto the underside of the piston can be heated up very quickly.

FIG. 9 illustrates a further exemplary embodiment lubrication system 100, corresponding largely to the embodiment of FIG. 1. The lubrication points of a structural environment 11 of a combustion engine comprise an oil gallery 10 with an oil-carrying inner part 12 that is supplied with lubricating oil through the oil gallery 10. An oil feed line 104 branches off from the oil gallery 10, and lubricates a cylinder head 27. The oil feed line 104 of the cylinder head 27, which could also lubricate a turbocharger, is connected downstream of an exhaust gas heat exchanger 60 as a heat source 7 to the cylinder block oil gallery 10. A coolant heat exchanger 24 is arranged in the oil feed line 104 of the cylinder head 27. The coolant heat exchanger 24 is connected to a feed and return 61*a*, 61*b* of a coolant circuit 61 which can cool or heat the lubricating oil as required. A coolant regulator valve 25 is provided for this purpose to regulate the heat exchange in the coolant heat exchanger 24.

It should be noted that the insulated oil lines are arranged in an oil supply region that is arranged behind the oil pump, i.e. in the pressurized line region. This line is, at least in certain areas, larger than the inner diameter of the line, so that an improved ratio of surface area to volume can be achieved. The insulation can preferably consist of plastic or ceramic, and can be arranged inside or outside the wall. The thermal conductivity of the insulated regions of the connecting line is 5% or less than that of the surrounding metal structure or the oil gallery, where in particular steel or cast iron has a thermal conductivity of about 50 W/(m·K), so that the insulation should have a thermal conductivity of 2.5 W/(m·K), preferably 1 W/(m·K) or less.

Further areas to be insulated, in addition to feed lines and the lubrication points, include in particular the transmission housing or, in a combustion engine, the crankcase, the oil sump and the oil gallery. The crankshaft, crankshaft bearings and crankcase, camshafts and bearings and gear shafts and gear wheels should in particular be considered for thermal insulation of rotating or oscillating components; preferably the regions to be insulated are those regularly wetted by oil when being used for their functions. It is advantageous if no fresh air gets into the crankcase, so that this is closed against cold external air and that at most blow-by gases emerge, but no fresh air can penetrate to the crankcase, to permit an increased or accelerated heating.

By the combination of two heat exchangers for engine oil and transmission oil and/or two thermal reservoirs for engine oil or transmission oil, a higher quality of insulation can be achieved in one unit, and a higher component quality in respect of leaks or corrosion can be achieved, while critical installation space can be saved. If a phase change material is used in the cooling circuit, it is appropriate to provide a second enclosing cooling circuit, wherein the first cooling circuit can be operated at higher temperatures and the second cooling circuit has the purpose of cooling the inner cooling circuit, wherein freezing or a solid state of the phase change material can be prevented, so that operational capability can be achieved even at very low external temperatures.

The invention claimed is:

1. A lubricating system for lubricating points of a rotating or oscillating component of an internal combustion engine and/or electric motor having an associated transmission and an associated source of electric energy, the system being integrated with the metal structure of the engine or the transmission and comprising (a) an oil reservoir;

(b) at least one oil suction pipe arranged in said oil reservoir;

(c) an oil pump connected to said oil suction pipe;

(d) a heat source powered by the engine or the source of electric energy, said heat source being connected to said oil pump and downstream therefrom;

(e) connecting lines for feeding oil to the lubricating points and for returning oil to said oil reservoir, at least one of said connecting lines between said heat source and a lubricating point downstream of said heat source having an internal wall for providing internal heat insulation, the thermal conductivity of said internal insulation being maximally 5% of the thermal conductivity of said connecting lines and the remainder of the structural environment; and (f) means for reducing the heat output of said heat source to a value that is between a lowered value and zero when a predetermined upper oil temperature is reached.

2. A lubricating system as defined in claim 1, wherein the engine is a combustion engine.

3. A lubricating system as defined in claim 2, wherein the thermal conductivity of the insulation of said one connecting line is less than 1 W/(m K) and the external circumference of said one connecting line is at least twice as large as its inner circumference.

4. A lubricating system as defined in claim 2, wherein said system has a housing having an internal insulation the thermal conductivity of which is maximally 5% of the thermal conductivity of the metallic structural environment and less than 1 W/(m K).

5. A lubricating system as defined in claim 4, wherein the engine has a crankshaft which has a housing, said housing being that of the lubricating system.

6. A lubricating system as defined in claim 2, wherein the engine is constituted by at least one combustion engine having pistons, an exhaust pipe and a crankcase which is free of any connecting line to the ambient air in consequence of which said crankcase cannot be cooled down by ambient air, said heat source comprising a connecting said exhaust pipe with said crankcase and a piston spray having nozzles for cooling the combustion engine, the volume flow of oil that is sprayed through said nozzles onto said pistons of the combustion engine constituting the largest volume flow conveyed by said oil pump and at least 30% of the oil volume conveyed by said oil pump, the system further comprising means for reducing the volume of flow of oil through said piston nozzles when the catalytic converter temperature is below activation limit temperature, for reducing the piston spray nozzle volume rate when the oil pressure falls below a predetermined limit, and for regulating the volume flow of said oil pump by increasing the conveying capacity of said oil pump to achieve an increased pumped value flow inside the thermal reservoir as soon as the outlet temperature of the thermal reservoir is below a predetermined oil outlet temperature of at most 90 degrees C. and an inlet temperature of the thermal reservoir is above a predetermined oil inlet limit temperature of at least 90 degrees C.

7. A lubricating system as defined in claim 1, wherein the engine is an electric motor.

8. A lubricating system as defined in claim 1, wherein the engine is a hybrid engine incorporating a combustion engine and an electric motor.

9. A lubricating system as defined in claim 1, wherein said source of electric energy is a battery.

10. A lubricating system as defined in claim 1, wherein said source of electric energy is an alternator.

11. A lubricating system as defined in claim 1, further comprising a thermal reservoir arranged between said oil suction pipe and a lubricating point, said reservoir being surrounded by insulation having a thermal conductivity of less than 0.01 W/(m K) for providing high insulation for the thermal reservoir.

12. A lubricating system as defined in claim 11, wherein said thermal reservoir is cylindrical and comprises a free piston of thermally insulating material which divides the thermal reservoir into first and second chambers, whereby when filling said first chamber of said reservoir with oil at a predetermined upper limit of at least 90 degrees C. a volume of oil is pushed back from said second chamber into the lubricating system and when oil is emptied from said first chamber in a cold starting phase under a predetermined lower oil limit temperature of maximally 50 degrees C. into the lubricating system, said second chamber is filled with oil so that the oil level in said reservoir remains constant and the thermal reservoir provides a heat source and a heat sink.

13. A lubricating system as defined in claim 1, wherein the engine has a combustion chamber and further comprising a coolant duct, said heat source comprising at least a part of an oil line between said combustion chamber and said coolant duct.

14. A lubricating system as defined in claim 1, wherein the engine is constituted by at least one combustion engine having at least one piston having a piston head and piston skirt, the piston skirt being provided with insulation the thermal conductivity of which is maximally 5% of the thermal conductivity of the piston skirt and less than 1 W/(m K), whereby the inside of the piston head is free of insulation.

15. A lubricating system as defined in claim 1, wherein said heat source comprises an exhaust gas heat exchanger which is structurally integrated into said thermal reservoir, said heat exchanger having at least first, second and third chambers, said first chamber being one through which at least a first portion of the exhaust gas can flow, said first chamber being bounded by a first separating wall, a phase change material arranged in a second wall on at least one of the sides of said first separating wall which is not in contact with the flowing exhaust gas; a phase change material arranged in said second chamber being bounded by a second separating wall, at least one side of said second separating wall being out of contact with said phase change material, lubricating oil flowing through said third chamber, the arrangement allowing the sequence of flow through said first, second and third chambers being continued in opposite sequence at least once; said phase change material having a latent heat of fusion that is greater than the heat that the thermal reservoir can store on the basis of the temperature difference between a predetermined lower oil limit temperature of 50 degrees C. and a predetermined upper limit temperature of 90 degrees C.

16. A lubricating system as defined in claim 15, wherein at least one of said separating walls surrounds its respective chamber.

17. A lubricating system as defined in claim 1, wherein the system, said oil reservoir, said structural environment and said heat source are enclosed in a motor vehicle having a combustion engine constituting the engine of the system and a motor vehicle transmission, and wherein said heat source is constituted by said combustion engine.

18. A lubricating system as defined in claim 17, further comprising a thermal reservoir for transmission oil of the motor vehicle, said thermal reservoir being structurally integrated as one unit with a coolant heat exchanger of a coolant circuit of the combustion engine for heating the transmission oil with coolant.

19. A lubricating system as defined in claim 17, wherein the combustion engine comprises an exhaust gas/oil heat exchanger for engine oil and transmission oil are integrated into a unit which is operated in a counter-flow manner, the region of the transmission oil/exhaust gas heat exchanger being downstream on the exhaust gas side form the region of the engine oil/exhaust gas heat exchanger.

20. A lubricating system as defined in claim 17, wherein the motor vehicle transmission is a manual transmission lacking an oil pump, the motor vehicle having a coolant heat exchanger arranged in said oil reservoir whereby the transmission oil is heated by a coolant of the engine, and wherein the coolant heat exchanger comprises, on the coolant side, a coolant valve which is closed when the oil temperature falls below a coolant limit temperature and is opened when the oil temperature exceeds the coolant limit temperature.

21. A lubricating system as defined in claim 17, wherein a coolant of a coolant circuit of the combustion engine comprises a phase change material having a melting temperature above 0 degrees C. and a boiling temperature of at least 120 degrees C. in which the density rises with rising temperature, the coolant circuit containing said phase change material being integrated into the combustion engine to be cooled there being no connecting lines leading to other components, and wherein a first coolant circuit is surrounded by and cooled by a second coolant circuit which is surrounded by and cooled by a second coolant circuit which is filled with a coolant having a melting temperature of least below −30 degrees C. and having components arranged outside of the combustion engine.

22. A lubricating system as defined in claim 21, wherein the density of said phase change material rises with temperature during the phase change from solid to liquid.

23. A method for cooling a lubricating system for lubricating points of a rotating or oscillating component of a combustion engine having an associated transmission, the system having an oil reservoir, a cooling circuit having a coolant pump, a cooler, a cylinder head coolant duct and a cylinder block coolant duct and the combustion engine constituting a heat source, said ducts being structurally separated from each other, and each duct comprising connecting lines for feeding to lubricating points and for returning oil to said oil reservoir, at least one of said connecting lines between said heat source and a lubricating point downstream of said heat source having an internal wall for providing internal heat insulation, the thermal conductivity of said internal heat insulation being maximally 5% of the thermal conductivity of said connecting lines and the remainder of the structural environment, the method comprising the steps of (a) during a warming-up phase below a first coolant temperature of maximally 90 degrees C., directing a coolant through a cylinder head to be heated and from there directing the coolant through a cylinder block thereby causing the now heated coolant to heat up the wall of the engine cylinder, and from there passing the coolant to the coolant pump;

(b) when said first coolant temperature is reach in the cylinder head passing at least part of the coolant flow to the cooler; and (c) when a second coolant limit temperature of at least 100 degrees C. is reached thermostatically closing a connection to the inlet of the coolant pump and opening a connection to the outlet of the coolant pump for causing coolant in the cylinder block to flow in a direction opposite to the flow of coolant in the cylinder head while passing the combined coolant flow from the cylinder head and the cylinder block through the cooler.

* * * * *